United States Patent [19]

Matejec et al.

[11] Patent Number: 4,985,351

[45] Date of Patent: Jan. 15, 1991

[54] PHOTOGRAPHIC RECORDING MATERIAL

[75] Inventors: Reinhart Matejec; Heinrich Odenwälder, both of Leverkusen; Hans Öhlschläger, Bergisch Gladbach; Erich Wolff, Solingen, all of Fed. Rep. of Germany

[73] Assignee: Agfa-Gevaert Aktiengesellschaft, Leverkusen, Fed. Rep. of Germany

[21] Appl. No.: 398,838

[22] Filed: Aug. 25, 1989

[30] Foreign Application Priority Data

Sep. 8, 1988 [DE] Fed. Rep. of Germany ..... 3830512

[51] Int. Cl.[5] ..... G03C 1/10; G03C 1/34

[52] U.S. Cl. ..... 430/598; 430/599; 430/607; 430/955

[58] Field of Search ..... 430/264, 268, 598, 599, 430/600, 607, 611, 613, 955

[56] References Cited

U.S. PATENT DOCUMENTS

| | | | |
|---|---|---|---|
| 4,668,605 | 5/1987 | Okutsu et al. | 430/268 |
| 4,737,452 | 4/1988 | Kameoka et al. | 430/611 |
| 4,800,150 | 1/1989 | Katoh | 430/624 |
| 4,914,003 | 4/1990 | Yagihara et al. | 430/607 |
| 4,952,485 | 8/1990 | Shibahara et al. | 430/611 |

*Primary Examiner*—Hoa Van Le

*Attorney, Agent, or Firm*—Connolly & Hutz

[57] ABSTRACT

A color photographic silver halide material of the negative type, in which at least one silver halide emulsion layer contains as compound corresponding to the following formula $$A-(Z)_n-F^* \quad (I)$$

adsorbed on the silver halide grain,

A being a grain-active attachment group corresponding to formulae IIa to IId:

IIa

IIb

IIc

IId

Z is a difunctional intermediate member,

F* is a latent fogging agent group which becomes the active fogging agent (F) during color development and n=0 or 1, is distinguished by improved sensitivity.

10 Claims, No Drawings

PHOTOGRAPHIC RECORDING MATERIAL

This invention relates to a color photographic silver halide material of the negative type having improved sensitivity.

It is known that the sensitivity of photographic silver halide materials can be increased by means of so-called DAR (development accelerator releasing) or FAR (fogging agent releasing) couplers which release either a development accelerator or a fogging agent during the coupling reaction with the developer oxidation product. Couplers of the type in question also include compounds which release part of a compound containing both a hydrazide group (fogging agent) and an attachment group for adsorption to the silver halide grain (DE-A 33 33 355, 3 410 616, EP-A-0 118 087, 0 147 765 and US-A-4,656,123). However, the increase in sensitivity obtained in this way is still inadequate for many applications.

Accordingly, the object of the present invention is to provide additives for photographic materials with which a further increase in sensitivity can be obtained.

It has now surprisingly been found that a further increase in sensitivity can be obtained by adsorbing compounds containing at least one grain-active attachment group and at least one latent fogging agent group before exposure to form an image.

Accordingly, the present invention relates to a color photographic silver halide material of the negative type, in which at least one silver halide emulsion layer contains a compound corresponding to the following formula $$A-(Z)_n-F^* \qquad (I)$$

adsorbed on the silver halide grain,

A being a grain-active attachment group corresponding to formulae IIa to IId:

IIa

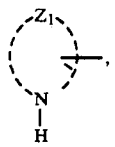

IIb

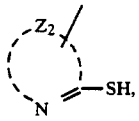

IIc

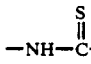

IId

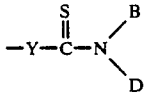

$Z_1$ representing the remaining members for completing a preferably 5- or 6-membered ring which contains at least one other heteroatom, such as a nitrogen or sulfur atom, and is optionally benzo- or naphtho-condensed, $Z_2$ representing the remaining members for completing a preferably 5- or 6-membered, optionally benzo- or naphtho-condensed ring, X representing $-NH_2$, NHR,

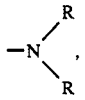

$-NH-NH_2$, $-NH-NHR$, $-SR$,

Y representing —S—, —NH—, —NR—,

B and D representing hydrogen, R or, together, the remaining members of a 5- or 6-membered ring, R representing an aliphatic, aromatic or heterocyclic radical, Z representing a difunctional intermediate member, F* is a latent fogging agent group which becomes the active fogging agent (F) during color development and n=0 or 1.

Preferred difunctional intermediate members Z are alkylene groups, arylene groups, $-COCH_2-$, $-COCH_2-S-$, $-COCH_2-O-$

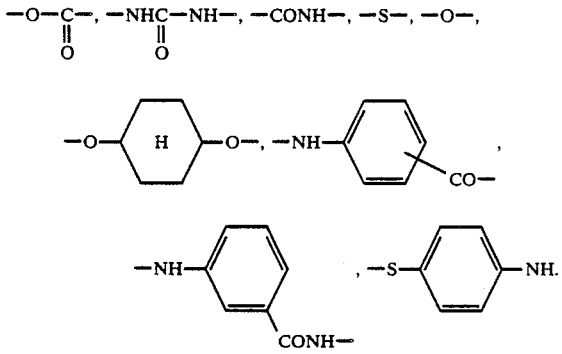

Preferred latent fogging agent groups F* correspond to formulae IIIa to IIIc:

IIIa

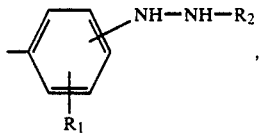

IIIb

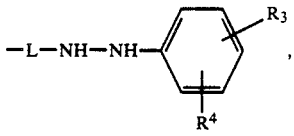

IIIc

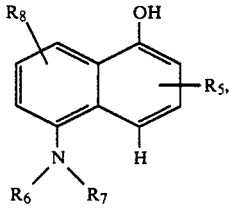

one of the substituents $R_5$, $R_6$, $R_7$ and $R_8$ in formula IIIc being the point of attachment for the residue $A-(Z-)_n-$. In formulae IIIa, IIIb and IIIc, $R_1$ is hydrogen, halogen, alkyl, alkoxy, $R_2$ is an acyl group, for example —CHO, —$COR_9$, —$COOR_9$, —$CONH_2$, —$CONHR_9$, —$SO_2R_9$, —$PO(R_9)_2$, —$PO(OR_9)_2$, $R_3$ is hydrogen, halogen, alkyl, alkoxy, $R_4$ is hydrogen, halogen, alkyl, alkoxy, acylamino, nitro or sulfonyl, $R_5$ is hydrogen, —$CONHR_9$, —$NHCOR_9$, —$SO_2NHR_9$, —$NHCOOR_9$, —$NHSO_2R_9$, —$NHCONHR_9$, $R_6$ is hydrogen or alkyl, $R_7$ is hydrogen or acyl, such as —$COR_9$, —$COOR_9$, —$CONHR_9$, $SO_2NHR_3$ or $R_6$ and $R_7$ together represent the remaining members of a heterocyclic ring or, together with the nitrogen atom, represent an azomethine group

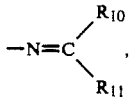

$R_8$ is hydrogen, alkoxy or acylamino, $R_8$ and $R_6$ together represent the remaining members of a heterocyclic ring, for example an imidazole or pyridone ring, which is condensed with the naphthol ring, $R_9$ is an optionally substituted, aliphatic or olefinic, cycloaliphatic or cycloolefinic, aromatic or heterocyclic group, $R_{10}$ is hydrogen, alkyl, aryl, $R_{11}$ is alkyl, aryl or hetaryl and L is a difunctional group which contains a —CO-group attached to the hydrazine group, for example

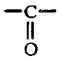

or

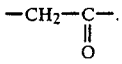

In a particularly preferred embodiment, compound I corresponds to formula (IV)

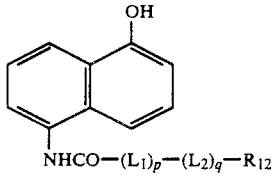

(IV)

in which $L_1$ represents $C_{1-6}$ alkylene, $L_2$ is a sulfur atom, $R_{12}$ is a heterocyclic radical, p=0 or 1 and q=0 or 1.

Preferred heterocyclic groups $R_{12}$ are 2-mercapto-1,3,4-thiadiazol-5-yl, 1-amino-2-mercapto-1,3,4-triazol-5-yl, 1-methyl-2-mercapto-1,3,4-triazol-5-yl, 2-mercapto-5-phenyl-1,3,4-triazol-1-yl, 1,2,3-triazol-4-yl, 2-mercapto-4-methyl-1,3-thiazol-5-yl, benztriazol-5-yl, imidazol-2-yl and 1,3,4-triazol-2-yl.

The compounds corresponding to formulae I and IV are preferably added to the silver halide emulsion after spectral sensitization, more especially in quantities of from 0.005 to 1 mmol/mol $AgNO_3$ and preferably in quantities of from 0.01 to 0.1 mmol/mol $AgNO_3$.

If the photographic material contains photosensitive layers of the same spectral sensitization, but different sensitivity, the compounds I and IV are preferably added to the layers of highest sensitivity. More particularly, the compounds corresponding to formulae I and IV are added to all the layers of highest sensitivity.

The following are examples of compounds according to the invention:

1.

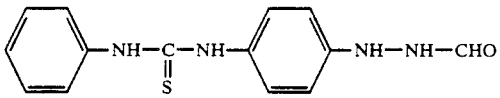

2.

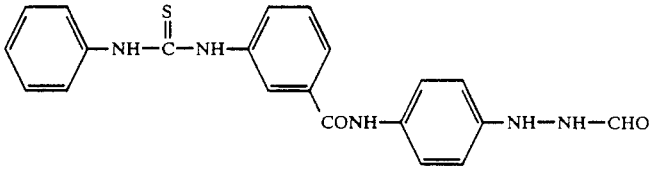

3.

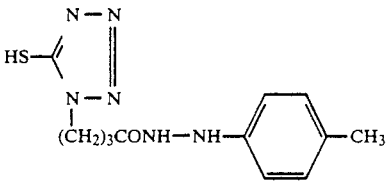

-continued
4.
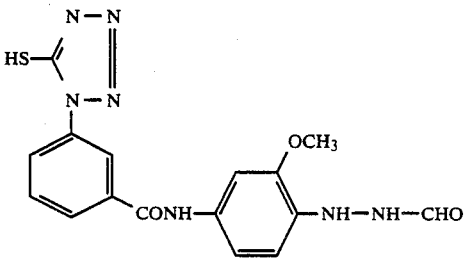
5.
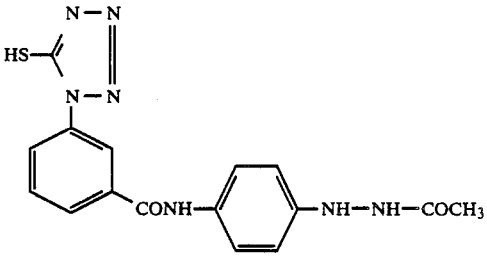
6.
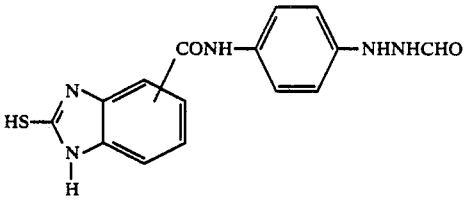
7.
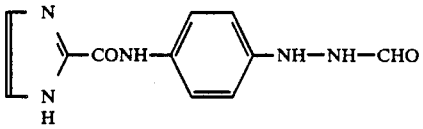
8.
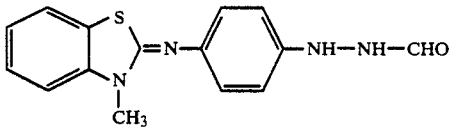
9.
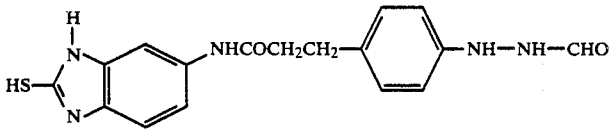
10.
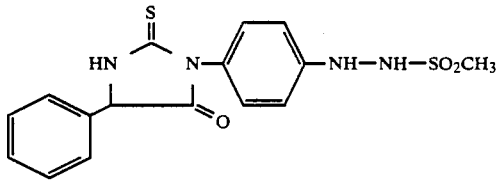
11.
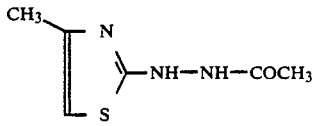

-continued
12.
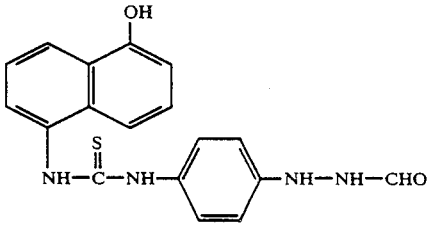
13.
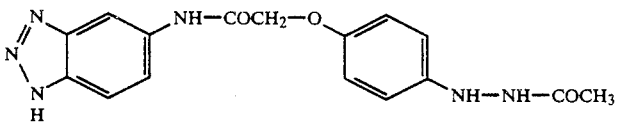
14.
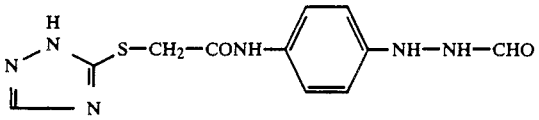
15.
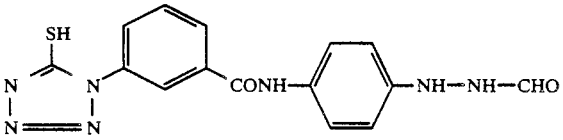
16.
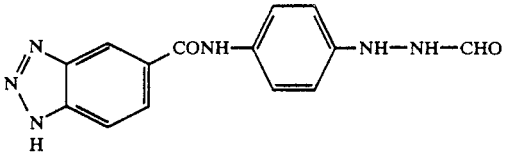
17.
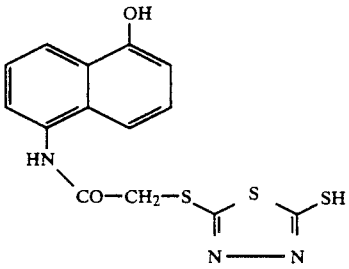
18.
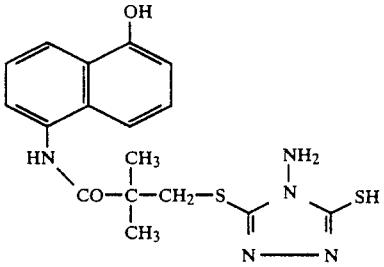
19.
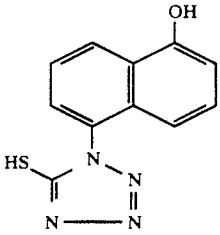

-continued
20.
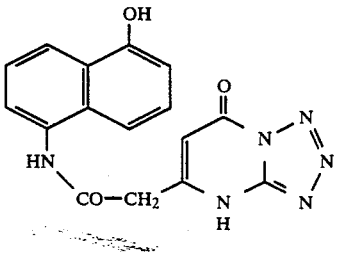
21.
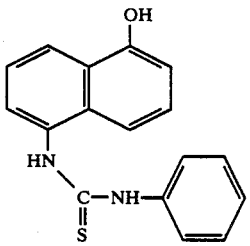
22.
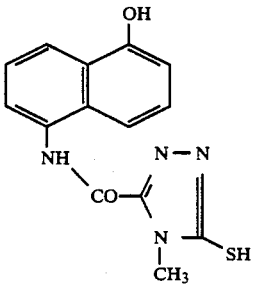
23.
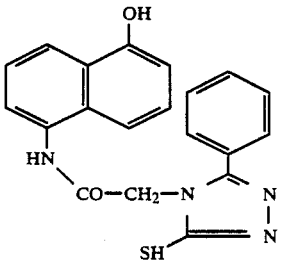
24.
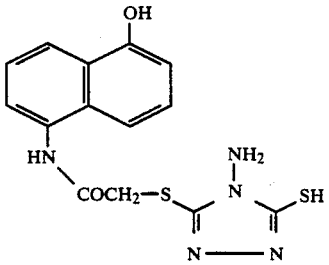
25.
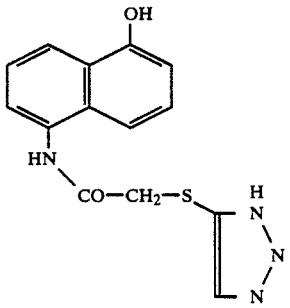

-continued
26.
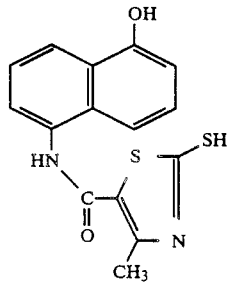
27.
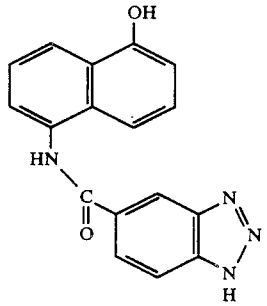
28.
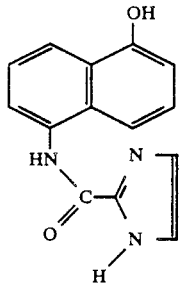
29.
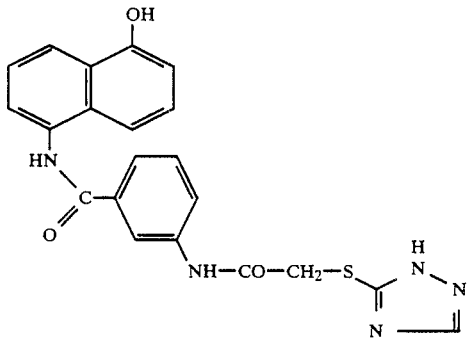
30.
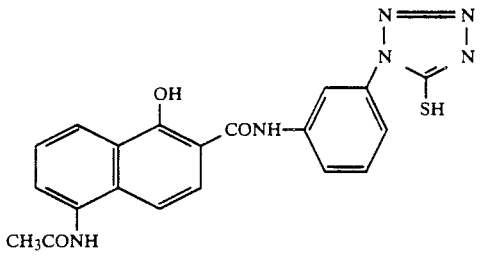

-continued

31.

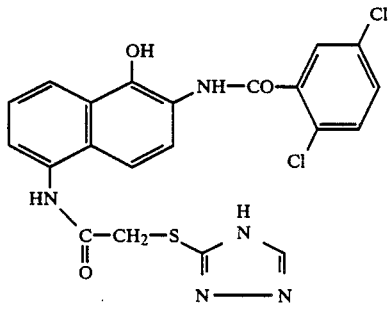

32.

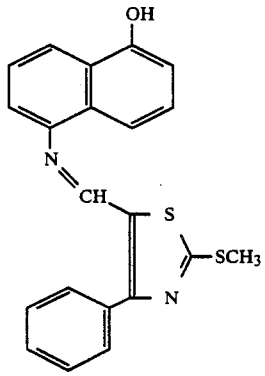

The compounds are partly known from the literature or may be produced by methods known from the literature.

The use of hydrazine derivatives in photography has been known for some time and is reported in detail in the Article entitled "Development Nucleation by Hydrazine and Hydrazine Derivatives", Research Disclosure no. 23 510, November, 1983.

Examples of color photographic materials of the negative type are color negative film and color photographic paper.

Suitable supports for the production of color photographic materials of the type in question are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or a layer of $\alpha$-olefin polymer (for example polyethylene). These supports may be colored with dyes and pigments, for example titanium dioxide. They may also be colored black for screening against light. The surface of the support is generally subjected to a treatment to improve the adhesion of the photographic emulsion layer, for example to a corona discharge followed by application of a substrate layer.

The color photographic materials normally contain at least one red-sensitive silver halide emulsion layer, at least one green-sensitive silver halide emulsion layer and at least one blue-sensitive silver halide emulsion layer and, optionally, intermediate layers and protective layers.

Essential constituents of the photographic emulsion layers are binders, silver halide crystals and color couplers.

Gelatine is preferably used as the binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. The production of such gelatines is described, for example, in The Science and Technology of Gelatine, edited by A. G. Ward and A. Courts, Academic Press 1977, pages 295 et seq. The particular gelatine used should contain as few photographically active impurities as possible (inert gelatine). Gelatines of high viscosity and low swelling are particularly advantageous.

The silver halide present as photosensitive constituent in the photographic material may contain as halide chloride, bromide or iodide or mixtures thereof. For example, 0 to 15 mol-% of the halide component of at least one layer may consist of iodide, 0 to 100 mol-% of chloride and 0 to 100 mol-% of bromide. Silver bromide iodide emulsions are normally used in the case of color negative films while silver chloride bromide emulsions are normally used in the case of color negative paper. The silver halide may consist of predominantly compact crystals which may have, for example, a cubic or octahedral form or transitional forms. However, the crystals may also preferably be platelet-like crystals in which the average diameter-to-thickness ratio is preferably at least 5:1, the diameter of a crystal being defined as the diameter of a circle with an area corresponding to the projected area of the crystal. However, the layers may also be platy silver halide crystals in which the diameter-to-thickness ratio is considerably greater than 5:1, for example between 12:1 and 30:1.

The silver halide crystals may also have a multilayer structure, in the most simple case with an inner core and an outer shell, the halide composition and/or other modifications, including for example doping of the individual crystal regions, being different. The average grain size of the emulsions is preferably between 0.2 μm and 2.0 μm and the grain size distribution may be both homodisperse and also heterodisperse. A homodisperse grain size distribution means that 95% of the grains differ by no more than ±30% from the average grain size. In addition to the silver halide, the emulsions may also contain organic silver salts, for example silver benztriazolate or silver behenate.

Two or more types of silver halide emulsion which have been separately prepared may be used in admixture.

The photographic emulsions may be prepared from soluble silver salts and soluble halides by various methods (cf. for example P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsion, The Focal Press, London (1966).

The halide silver is preferably precipitated in the presence of the binder, for example gelatine, in the acidic, neutral or alkaline pH range, silver halide complexing agents preferably being additionally used. Silver halide complexing agents include, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate, at which new nuclei are just still not formed, should not be exceeded. The pAg range may vary within wide limits during precipitation it is preferred to use the so-called pAg-control process in which a certain pAg value is kept constant or in which the pAg value passes through a certain profile during the precipitation process. In addition to the preferred precipitation in the presence of excess halide, however, so-called inverse precipitation carried out in the presence of excess silver ions is also possible. The silver halide crystals may be grown not only by ripening, but also by physical ripening (Ostwald ripening) in the presence of excess halide and/or silver halide complexing agents. The emulsion grains may even be grown predominantly by Ostwald ripening, in which case a fine-grain, so-called Lippmann emulsion is mixed with a less readily soluble emulsion and is dissolved in and allowed to crystallize thereon.

Salts or complexes of metals, such as Cd, Zn, Pb, Tl, Bi, Ir, Rh, Fe, may also be present during the precipitation and/or physical ripening of the silver halide grains.

In addition, precipitation may also be carried out in the presence of sensitizing dyes. Complexing agents and/or dyes may be inactivated at any time, for example by changing the pH value or by oxidative treatment.

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and sensitizing concentration) until optimal sensitivity and fogging are reached. The procedure is described, for example, in H. Frieser "Die Grundlagen der Photographischen Prozesse mit Silberhalogeniden" pages 675–734, Akademische Verlagsgesellschaft (1968).

The chemical sensitization of the silver halide emulsion may be carried out with addition of compounds of sulfur, selenium, tellurium and/or compounds of metals belonging to VIIIth secondary group of the periodic system (for example gold, platinum, palladium, iridium) and also with addition of thiocyanate compounds, surface-active compounds, such as thioethers, heterocyclic nitrogen compounds (for example imidazoles, azaindenes) or even spectral sensitizers (described, for example, in F. Hamer "The Cyanine Dyes and Related Compounds", 1964, in Ullmanns Encyclopädie der technischen Chemie, 4th Edition, Vol. 18, pages 431 et seq and in Research Disclosure no. 17643, Chapter III). Instead of or in addition to this chemical sensitization, the silver halide emulsion may also be subjected to reduction sensitization in the presence of reducing agents (tin (II) salts, amines, hydrazine derivatives, aminoboranes, silanes, formamidine sulfinic acid) using hydrogen, a low pAg value (for example below 5) and/or a high pH value (for example above 8).

The photographic emulsions may contain compounds to prevent fogging or to stabilize the photographic function during production, storage and photographic processing.

Particularly suitable compounds are azaindenes, preferably tetra- and pentaazaindenes, particularly those substituted by hydroxyl or amino groups. Compounds such as these are described, for example, by Birr in Z. Wiss. Phot. 47 (1952), pages 2 to 58. Other suitable antifogging agents are salts of metals, such as mercury or cadmium, aromatic sulfonic or sulfinic acids, such as benzenesulfinic acid, or nitrogen-containing heterocycles, such as nitrobenzimidazole, nitroindazole, optionally substituted benztriazoles or benzthiazolium salts. Particularly suitable are heterocycles containing mercapto groups, for example mercaptobenzthiazoles, mercaptobenzimidazoles, mercaptotetrazoles, mercaptothiodiazoles, mercaptopyrimidines; these mercaptoazoles may also contain a water-solubilizing group, for example a carboxyl group or sulfo group. Other suitable compounds are published in Research Disclosure no. 17643 (1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive materials produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, synthetic surface-active compounds (surfactants) are mainly used, including nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfuric or phosphoric acid esters of an aminoalcohol.

The photographic emulsions may be spectrally sensitized using methine dyes or other dyes. Particularly suitable dyes are cyanine dyes, merocyanine dyes and complex merocyanine dyes.

A review of polymethine dyes suitable as spectral sensitizers, combinations and super-sensitizing combinations thereof can be found in Research Disclosure 17643, 1978, Chapter IV.

The following dyes (in order of spectral region) are particularly suitable:

1. As red sensitizers
   9-Ethyl carbocyanines containing benzthiazole, benzselenazole or naphthothiazole as basic terminal groups, which may be substituted in the 5- and/or 6-position by halogen, methyl, methoxy, carbalkoxy, aryl; and 9-ethyl naphthoxathia- or -selenocarbocyanines and 9-ethyl naphthothioxa- or -benzimidazocarbocyanines, providing the dyes contain at least one sulfoalkyl group at the heterocyclic nitrogen.
2. As green sensitizers
   9-Ethyl carbocyanines containing benzoxazole, naphthoxazole or a benzoxazole and a benzthiazole as basic terminal groups and also benzimidazocarbocyanines which may also be further sustituted and, likewise, must also contain at least one sulfoalkyl group at the heterocyclic nitrogen.
3. As blue sensitizers
   Symmetrical or asymmetrical benzimidazo, oxa, thia or selenacyanines containing at least one sulfoalkyl group at the heterocyclic nitrogen and, optionally, further substituents at the aromatic nucleus and also apomerocyanines containing a thiocyanine group.

The following red sensitizers RS, green sensitizers GS and blue sensitizers BS are mentioned as examples, particularly of negative and reversal film, being useable either individually or in combination with one another, for example RS 1 and RS 2 and also GS 1 and GS 2

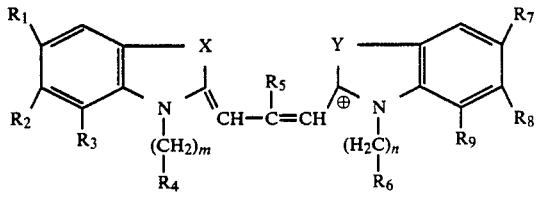

RS 1: $R_1$, $R_3$, $R_7$, $R_9$=H; $R_2$, $R_8$=Cl; $R_4$=$SO_3^{\ominus}\oplus NH(C_2H_5)_3$; $R_5$=$C_2H_5$; $R_6$=$SO_3^{\ominus}$; m, n=3; X, Y=S;

RS 2: $R_1$, $R_3$, $R_9$=H; $R_2$=Phenyl;

$$R_4 = -\underset{\underset{CH_3}{|}}{CH}-SO_3^{\ominus}K^{\oplus};$$

$R_5$=$C_2H_5$; $R_6$=$SO_3^{\ominus}$; $R_7$, $R_8$=—$OCH_3$; m=2; n=3; x=O; Y=S;

RS 3: $R_1$, $R_9$=H; $R_2$, $R_3$ together —CH=CH—CH=CH—; $R_4$=$SO_3^{\ominus}Na^{\oplus}$; $R_5$=$C_2H_5$; $R_6$=$SO_3^{\ominus}$; $R_7$, $R_8$=Cl; m, n=3; X=S; Y=N—$C_2H_5$;

RS 4: $R_1$=$OCH_3$; $R_2$, $R_8$=$CH_3$; $R_3$, $R_4$, $R_7$, $R_9$=H; $R_5$=$C_2H_5$; $R_6$=$SO_3^{\ominus}$; m=2; n=4; X=S; Y=Se;

RS 5: $R_1$, $R_7$=H; $R_2$, $R_3$ and $R_8$, $R_9$ together —CH=CH—CH=CH—; $R_4$=$SO_3^{\ominus}\oplus NH(C_2H_5)_3$; $R_5$=$C_2H_5$; $R_6$=$SO_3^{\ominus}$; m=2; n=3; X, Y=S;

GS 1: $R_1$, $R_3$, $R_7$, $R_9$=H; $R_2$=Phenyl;

$$R_4 = \underset{\underset{CH_3}{|}}{CH}-SO_3^{\ominus}\overset{\oplus}{N}H(C_2H_5)_3;$$

$R_5$=$C_2H_5$; $R_6$=$SO_3^{\ominus}$; $R_8$=Cl; m=2; n=3; X, Y=O;

GS 2: $R_1$, $R_2$, $R_7$, $R_8$=Cl; $R_3$, $R_5$, $R_6$, $R_9$=H;

$$R_4 = -\underset{\underset{CH_3}{|}}{CH}-SO_3^{\ominus};$$

m, n=2; X, Y=N-$C_2H_5$;

GS 3: $R_1$, $R_7$=H; $R_2$, $R_3$ and $R_8$, $R_9$ together —CH=CH—CH=CH—; $R_4$=$SO_3^{\ominus}Na^{\oplus}$; $R_5$=$C_2H_5$; $R_6$=$SO_3^{\ominus}$; m, n=3; X, Y=O;

GS 4: $R_1$, $R_3$, $R_4$, $R_7$, $R_8$, $R_9$=H; $R_2$=$OCH_3$; $R_5$=$C_2H_5$; $R_6$=$SO_3^{\ominus}$; m=2; n=4; X=O; Y=S;

BS 1:

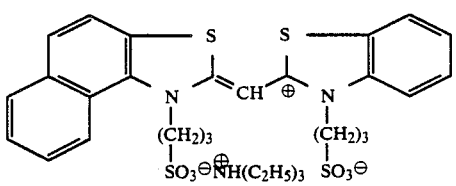

BS 2:

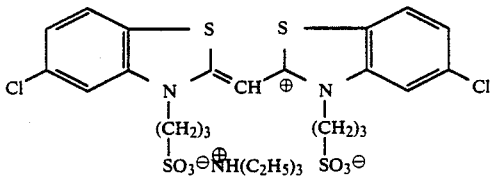

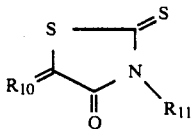

BS 3:

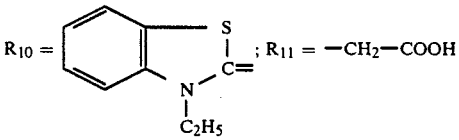

-continued

BS 4:

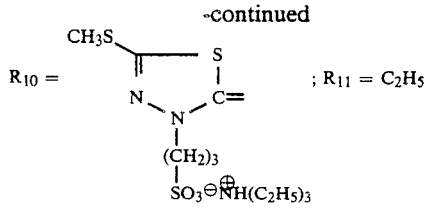

BS 5:

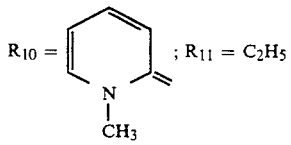

Sensitizers need not be used where the natural sensitivity of the silver halide is sufficient for a certain spectral region, for example the blue sensitivity of silver bromides.

Non-diffusing monomeric or polymeric color couplers are associated with the differently sensitized emulsion layers and may be situated in the same layer or in an adjacent layer. Normally, cyan couplers are associated with the red-sensitive layers, magenta couplers with the green-sensitive layers and yellow couplers with the blue-sensitive layers.

Color couplers for producing the cyan component dye image are generally couplers of the phenol or α-naphthol type, of which the following are suitable examples:

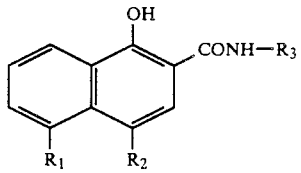

BG 1:

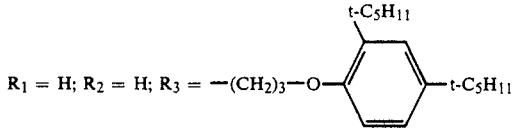

BG 2: $R_1$=NHCOOCH$_2$—CH(CH$_3$)$_2$; $R_2$=H; $R_3$=—(CH$_2$)$_3$—OC$_{12}$H$_{25}$

BG 3: $R_1$=H; $R_2$=—OCH$_2$—CH$_2$—SO$_2$CH$_3$; $R_3$=C$_{16}$H$_{33}$

BG 4: $R_1$=H; $R_2$=—OCH$_2$—CONH—(CH$_2$)$_2$—OCH$_3$;

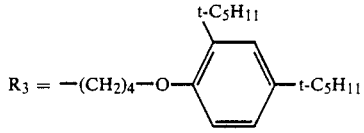

BG 5: $R_1$=H; $R_2$=H;

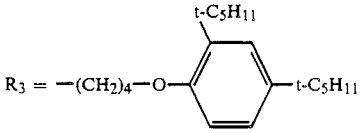

BG 6:

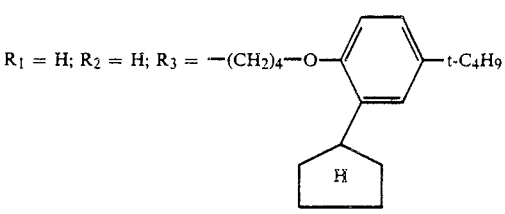

BG 7: $R_1$=H; $R_2$=Cl; $R_3$=—C (C$_2$H$_5$)$_2$—(CH$_2$)$_{20}$—CH$_3$

BG 8: $R_1$=H; $R_2$=—O—CH$_2$—CH$_2$—S—CH(COOH)—C$_{12}$H$_{25}$ $R_3$=Cyclohexyl

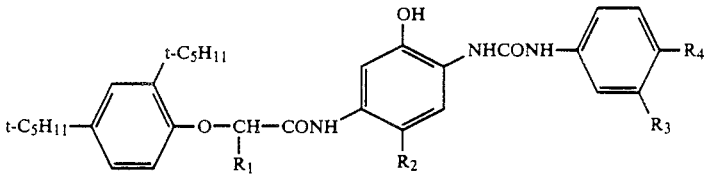

BG 9: $R_1$=—C$_4$H$_9$; $R_2$=H; $R_3$=—CN; $R_4$=Cl

BG 10: $R_1$=—C$_4$H$_9$; $R_2$=H; $R_3$=H; $R_4$=—SO$_2$CHF$_2$

BG 11:

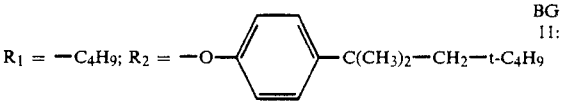

$R_3$ = H; $R_4$ = —CN

BG 12: $R_1$=C$_2$H$_5$; $R_2$=H; $R_3$=H; $R_4$=—SO$_2$CH$_3$

BG 13: $R_1$=—C$_4$H$_9$; $R_2$=H; $R_3$=H; $R_4$=—SO$_2$—C$_4$H$_9$

BG 14: $R_1$=—C$_4$H$_9$; $R_2$=H; $R_3$=—CN; $R_4$=—CN

BG 15: $R_1$=—C$_4$H$_9$; $R_2$=H; $R_3$=H; $R_4$=—SO$_2$—CH$_2$—CHF$_2$

BG 16: $R_1$=—C$_2$H$_5$; $R_2$=H; $R_3$=H; $R_4$=—SO$_2$CH$_2$—CHF—C$_3$H$_7$

BG 17: $R_1$=—C$_4$H$_9$; $R_2$=H; $R_3$=H; $R_4$=F

BG 18: $R_1$=—C$_4$H$_9$; $R_2$=H; $R_3$=H; $R_4$=—SO$_2$CH$_3$

BG 19: $R_1$=—$C_4H_9$; $R_2$=H; $R_3$=H; $R_4$=—CN

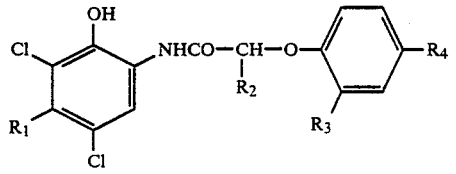

BG 20: $R_1$=—$CH_3$; $R_2$=—$C_2H_5$; $R_3$, $R_4$=—t—$C_5H_{11}$

BG 21: $R_1$=—$CH_3$; $R_2$=H; $R_3$, $R_4$=—t—$C_5H_{11}$

BG 22: $R_1$=—$C_2H_5$; $R_2$=—$C_2H_5$; $R_3$, $R_4$=—t—$C_5H_{11}$

BG 23: $R_1$=—$C_2H_5$; $R_2$=—$C_4H_9$; $R_3$, $R_4$=—t—$C_5H_{11}$

BG 24: $R_1$=—$C_2H_5$; $R_2$=—$C_4H_9$; $R_3$, $R_4$=—t—$C_4H_9$

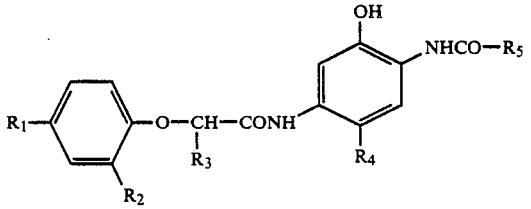

BG 25: $R_1$, $R_2$=—t—$C_5H_{11}$; $R_3$=—$C_4H_9$; $R_4$=H; $R_5$=—$C_3F_7$

BG 26: $R_1$=—$NHSO_2$—$C_4H_9$; $R_2$=H; $R_3$=—$C_{12}H_{25}$; $R_4$=Cl; $R_5$=Phenyl BG 27: $R_1$, $R_2$=—t—$C_5H_{11}$; $R_2$=Cl, $R_3$=—$CH(CH_3)_2$; $R_4$=Cl; $R_5$=Pentafluorophenyl BG 28: $R_1$=—t—$C_5H_{11}$; $R_2$=Cl; $R_3$=—$C_6H_{13}$; $R_4$=Cl; $R_5$=—2-Chlorophenyl Color couplers for producing the magenta component dye image are generally couplers of the 5-pyrazolone type, the indazolone type and the pyrazoloazole type, of which the following are suitable examples:

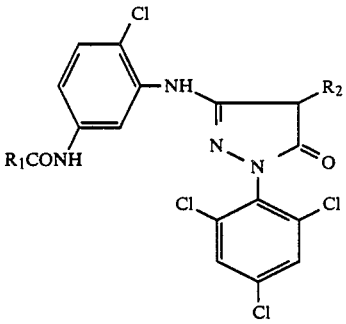

PP 1

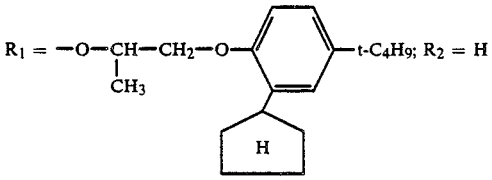

PP 2

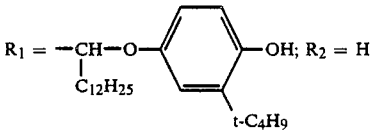

PP 3: $R_1$=—$C_{13}H_{27}$; $R_2$=H

PP 4: $R_1$=—O—$C_{16}H_{33}$; $R_2$=H

PP 5

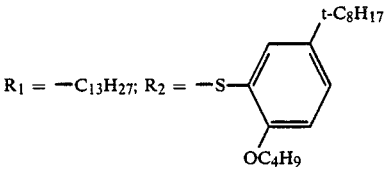

PP 6

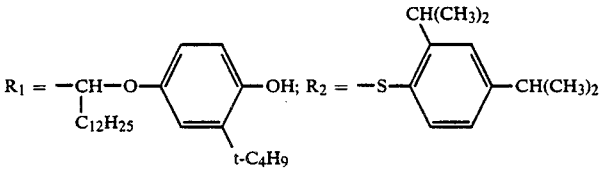

PP 7

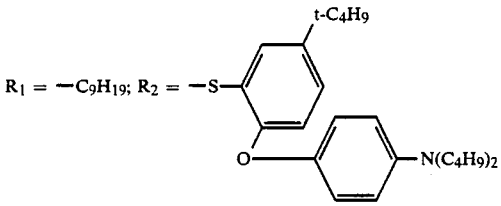

PP 8

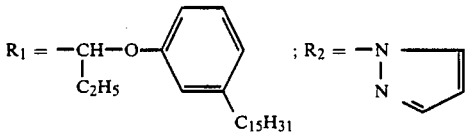

-continued
PP 9
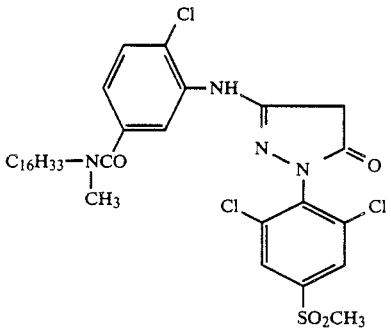
PP 10
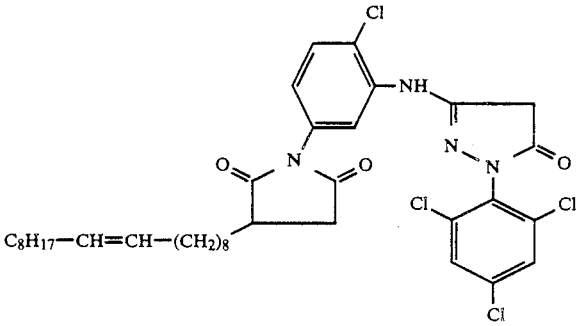
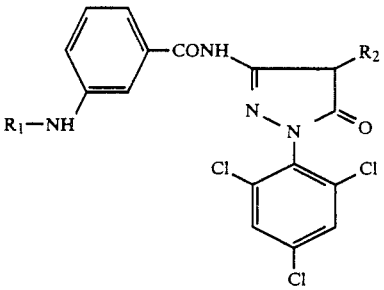
PP 11
$R_1 = -SO_2-C_6H_4-OC_{12}H_{25}$; $R_2 = H$
PP 12
$R_1 = -CO-CH_2-O-C_6H_3(t\text{-}C_5H_{11})-t\text{-}C_5H_{11}$; $R_2 = H$
PP 13
$R_1 = -CO-CH(C_2H_5)-O-C_6H_3(t\text{-}C_5H_{11})-t\text{-}C_5H_{11}$; $R_2 = H$
PP 14
$R_1 = -CO-CH(C_2H_5)-O-C_6H_3(t\text{-}C_5H_{11})-t\text{-}C_5H_{11}$;
$R_2 = -O-C_6H_4-COOC_2H_5$ -continued
PP 15
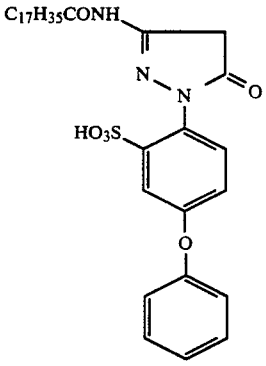
PP 16
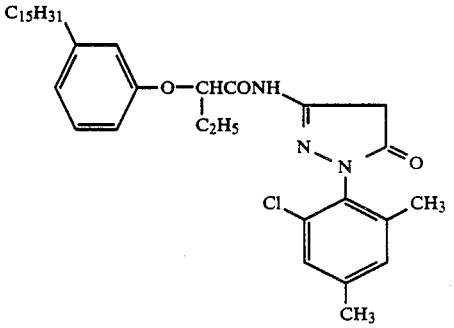
PP 17
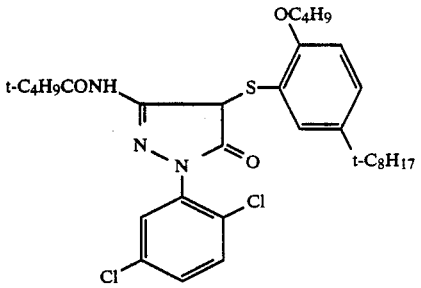
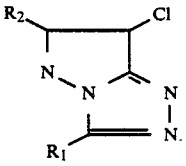
PP-18
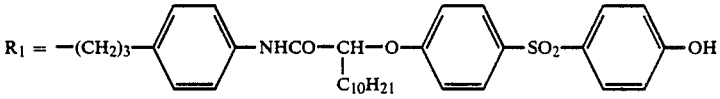
$R_2 = -CH_3$
PP 19
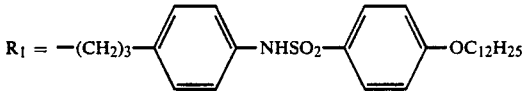
$R_2 = -CH_3$ -continued

PP 20

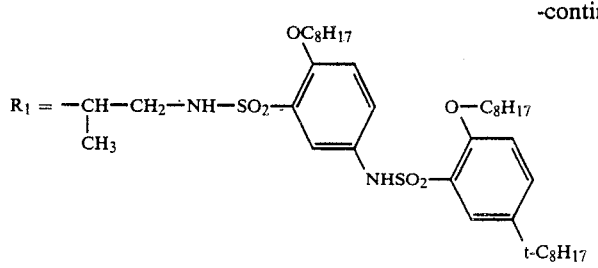

$R_2$ = -t-$C_4H_9$

PP 21

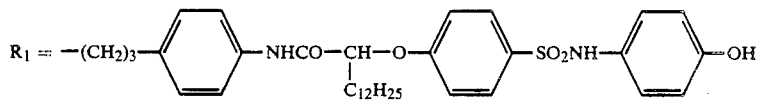

$R_2$ = $-CH_3$

PP 22

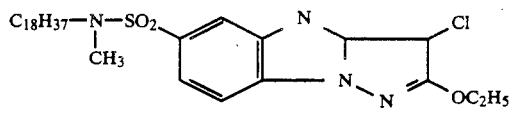

Color couplers for producing the yellow component dye image are generally couplers containing an open-chain ketomethylene group, more especially couplers of the α-acylacetamide type, of which suitable examples are α-benzoyl acetanilide couplers and α-pivaloyl acetanilide couplers corresponding to the following formulae:

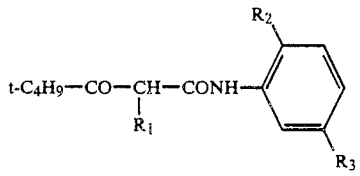

GB 1

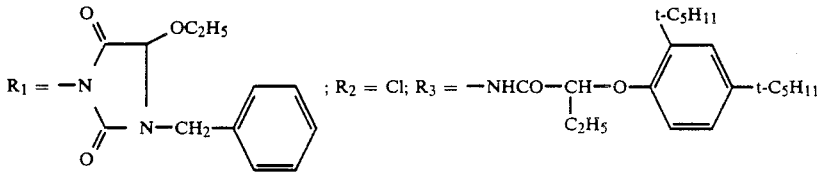

GB 2

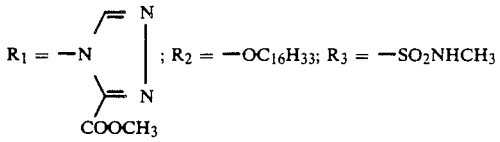

GB 3

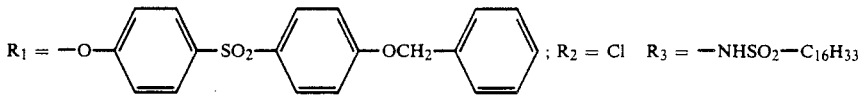

GB 4

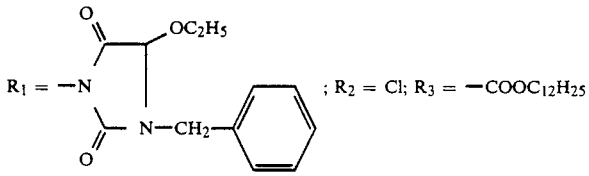

GB 5

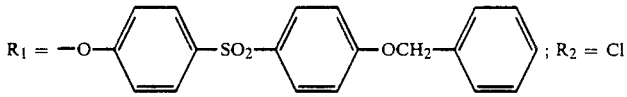

-continued
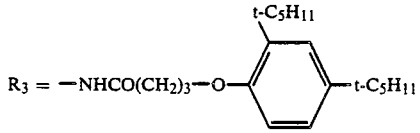
GB 6
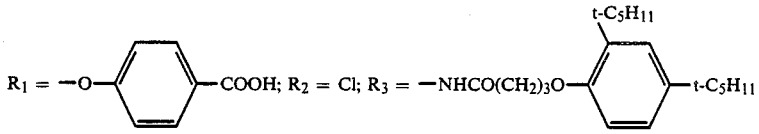
GB 7
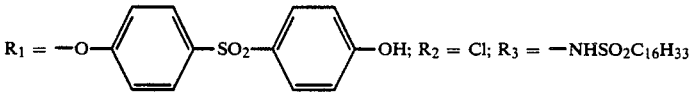
GB 8
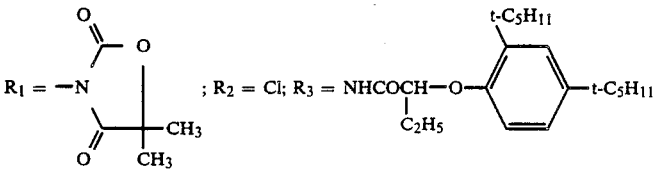
GB 9
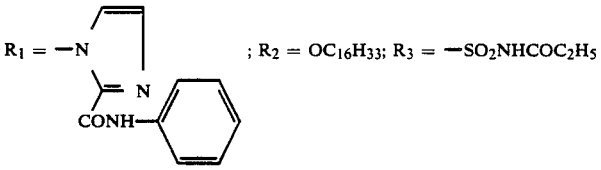
GB 10
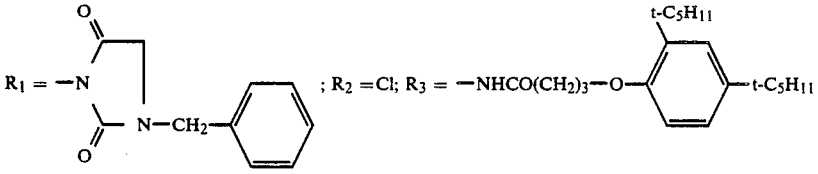
GB 11
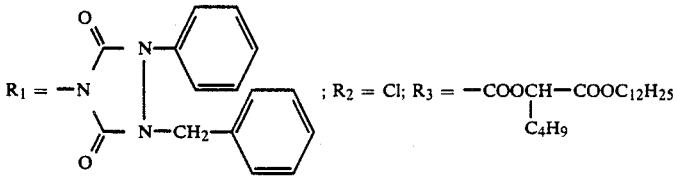
GB 12
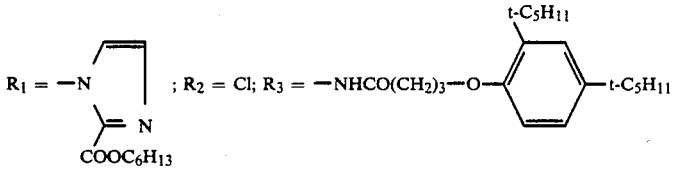
GB 13
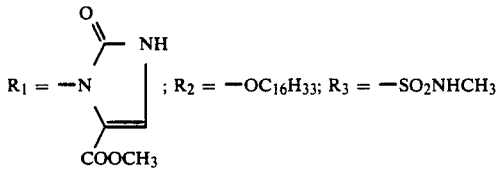

-continued
GB 14
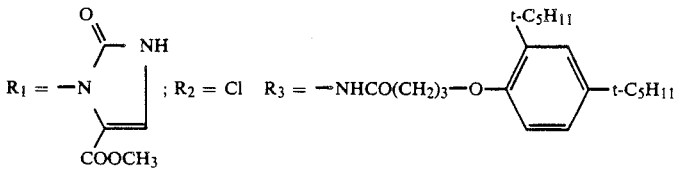
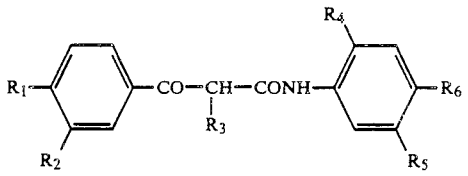
GB 15
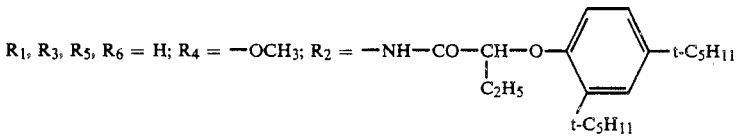
GB 16
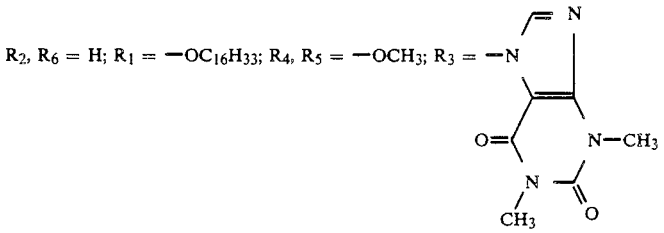
GB 17
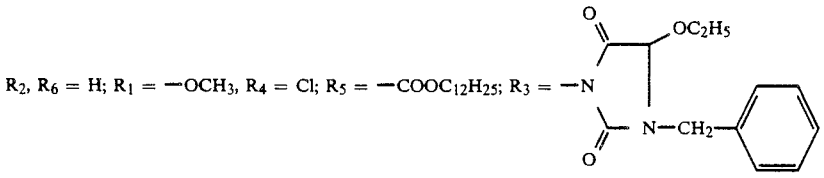
GB 18
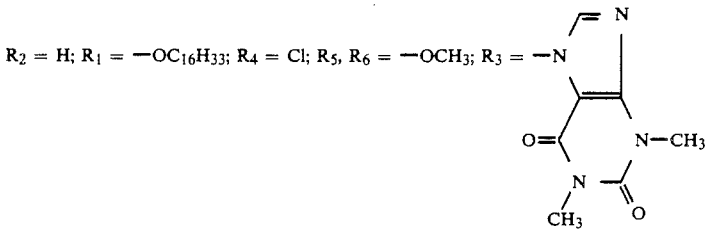
GB 19
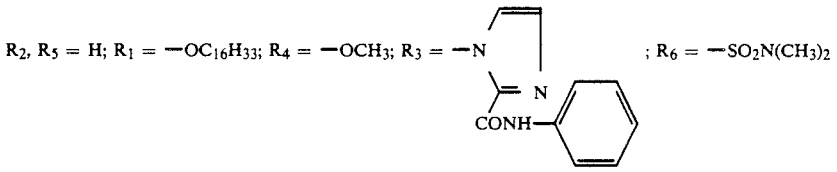
GB 20
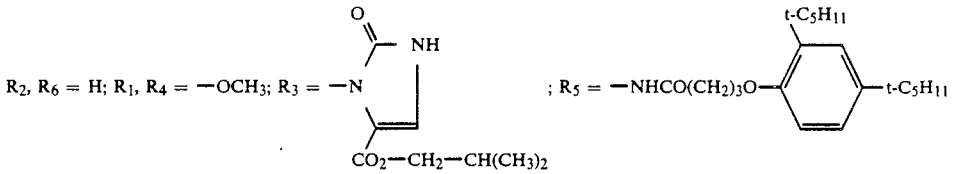

-continued

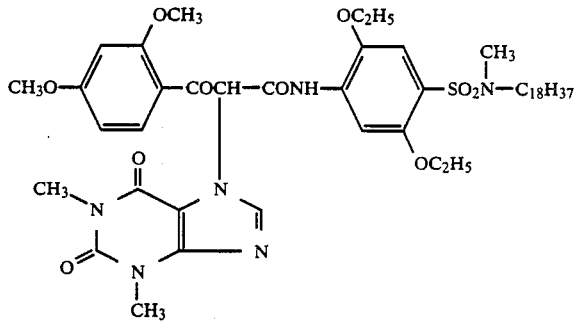

The color couplers may be 4-equivalent couplers and also 2-equivalent couplers. 2-Equivalent couplers are derived from 4-equivalent couplers in that they contain in the coupling position a substituent which is eliminated during the coupling reaction. 2-Equivalent couplers include those which are colorless and also those which have a strong color of their own that either disappears during the color coupling reaction or is replaced by the color of the image dye produced (mask couplers) and also white couplers which produce substantially colorless products on reaction with color developer oxidation products. 2-Equivalent couplers also include couplers which contain in the coupling position a releasable group which is released on reaction with color developer oxidation products and develops a certain desirable photographic activity, for example as a development inhibitor or accelerator, either directly or after one or more further groups have been released from the group initially released (cf. for example DE-A-27 03 145, DE-A-28 55 697, DE-A-31 05 026, DE-A-33 19 428). Examples of 2-equivalent couplers such as these are the known DIR couplers and also DAR and FAR couplers, of which the latter may be used in addition to the compounds according to the invention.

The following are examples of white couplers:

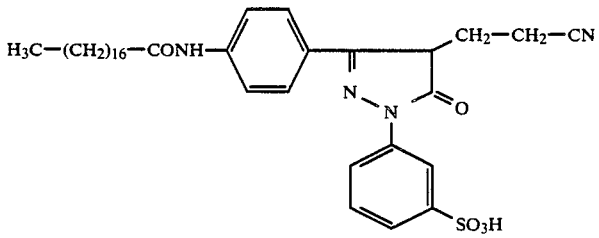

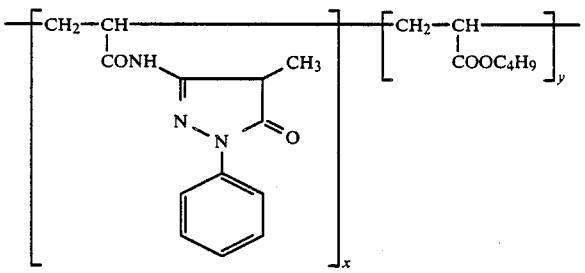

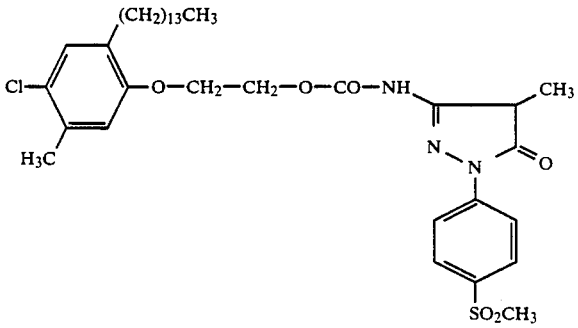

-continued
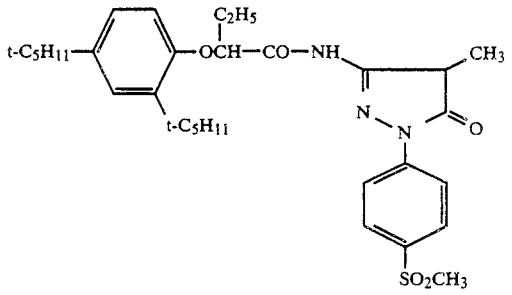
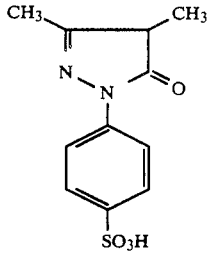
The following are examples of mask couplers:
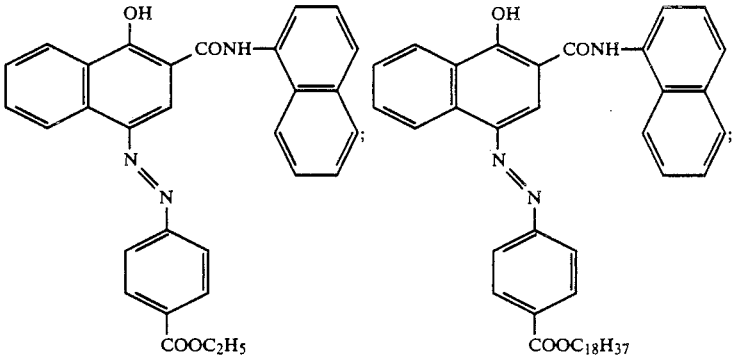
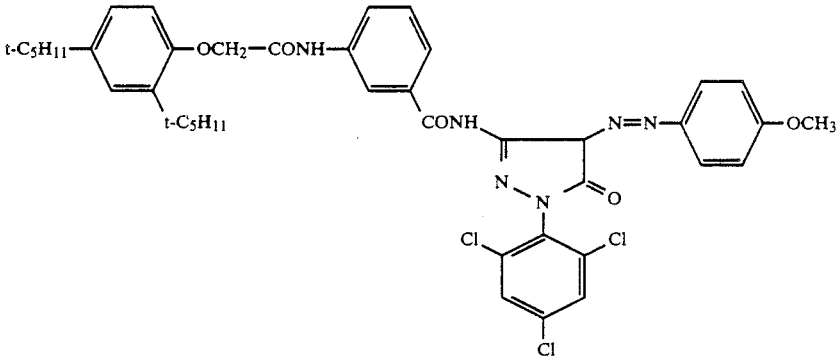
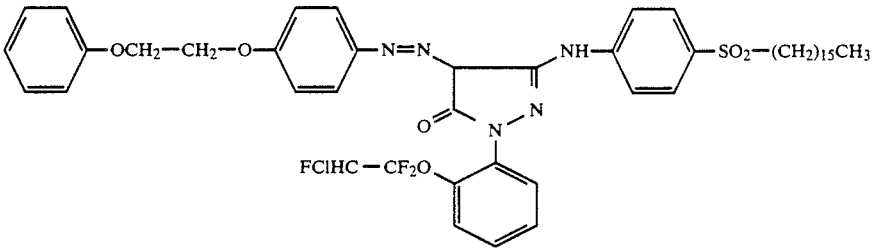

-continued
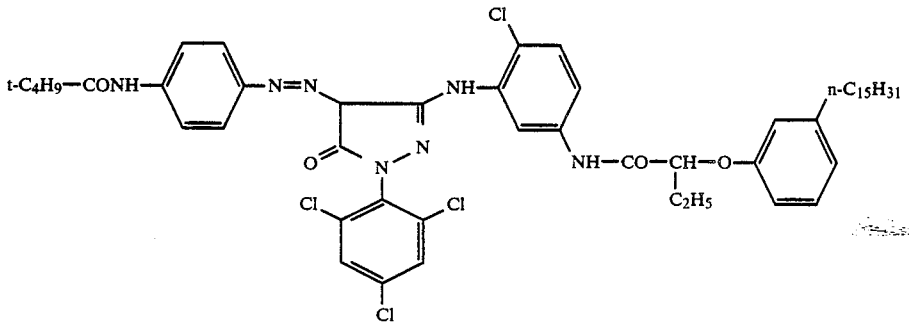
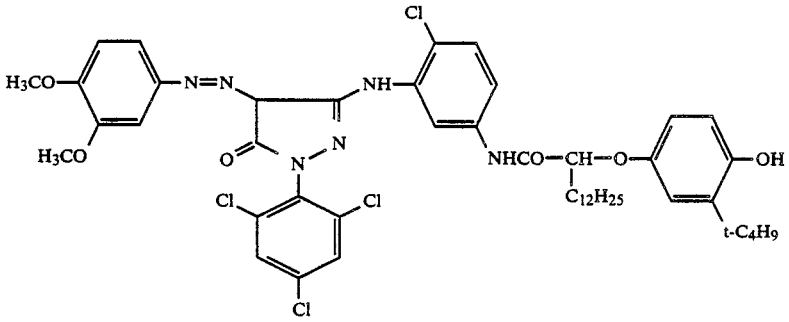
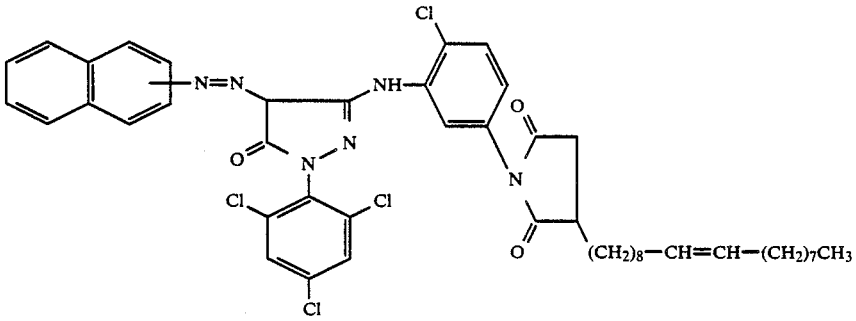
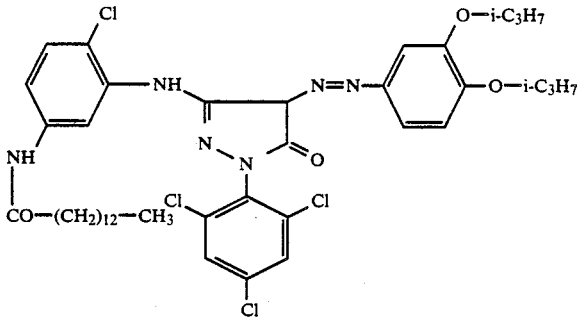
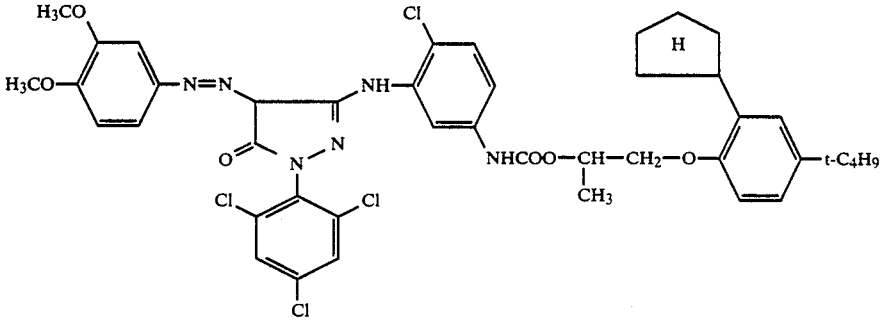

-continued
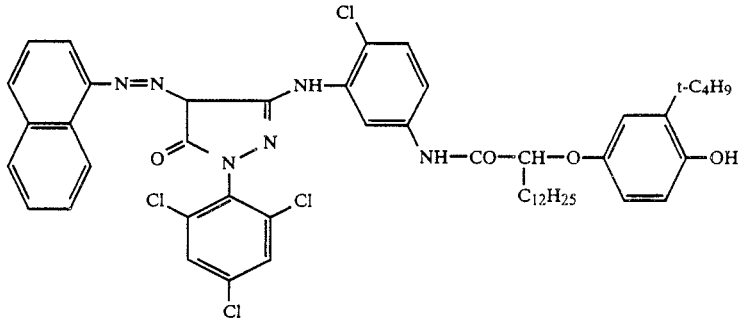
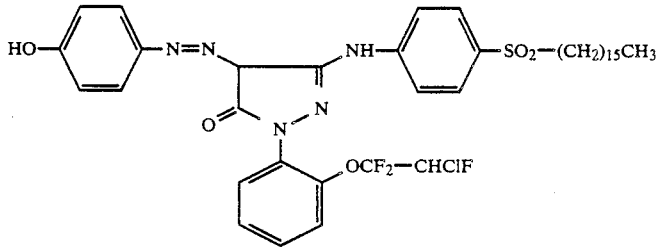
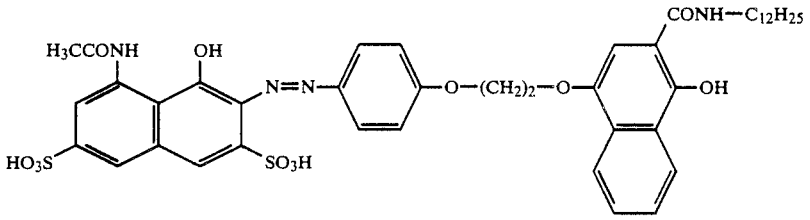
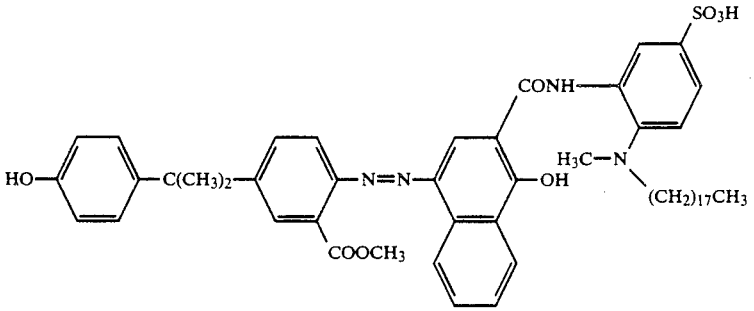
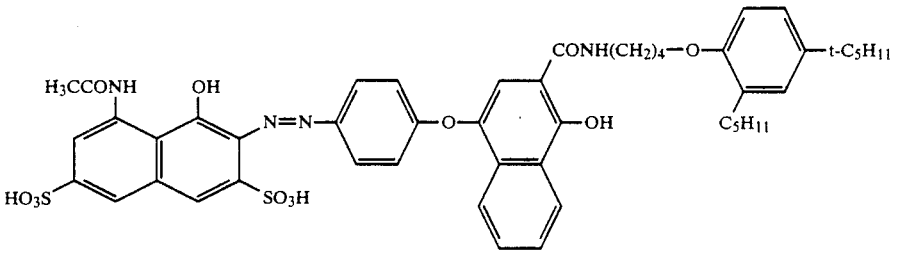

-continued

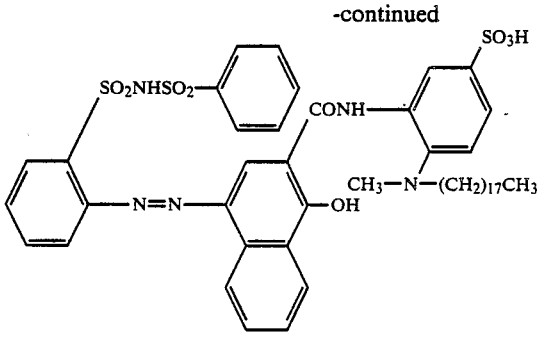

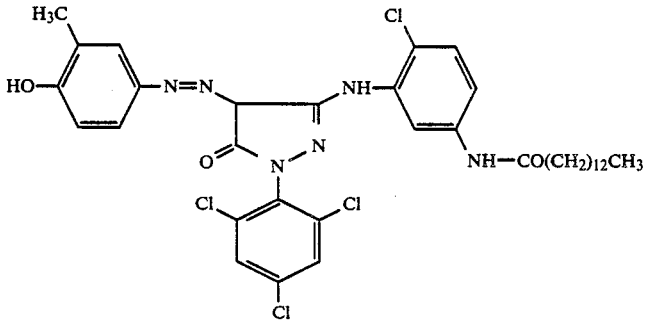

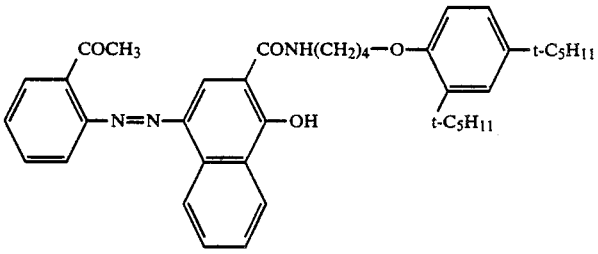

DIR couplers which release development inhibitors of the azole type, for example triazoles and benzotriazoles, are described in DE-A-2 414 006, 2 610 546, 2 659 417, 2 754 281, 2 726 180, 3 626 219, 3 630 564, 3 636 824, 3 644 416 and 2 842 063. Further advantages in regard to color reproduction, i.e. color separation and color purity, and in regard to reproduction of detail, i.e. sharpness and grain, can be obtained with DIR couplers from which the development inhibitor for example is not released as the direct result of coupling with an oxidized color developer, but instead is only released after another following reaction achieved, for example, with a time control group. Examples of DIR couplers such as these can be found in DE-A-28 55 697, 32 99 671, 38 18 231, 35 18 797; in EP-A-157 146 and 204 175; in US-A-4,146,396 and 4,438,393 and in GB-A-2,072,363.

DIR couplers releasing a development inhibitor which is decomposed in the developer bath to substantially photographically inactive products are described, for example, in DE-A-32 09 486 and in EP-A-167 168 and 219 713. Interference-free development and processing stability are achieved by this measure.

Where DIR couplers, particularly those releasing a readily diffusing development inhibitor, are used, improvements in color reproduction, for example a more differentiated color reproduction, can be obtained by suitable measures during optical sensitization, as described for example in EP-A-115 304, 167 173, GB-A-2,165,058, DE-A-3 700 419 and US-A-4,707,436.

The DIR couplers may be added to the most diverse layers, including even non-photosensitive layers or intermediate layers for example, of a multilayer photographic material. However, they are preferably added to the photosensitive silver halide emulsion layers, the characteristic properties of the silver halide emulsion, for example its iodide content, the structure of the silver halide grains or their grain size distribution influencing the photographic properties obtained. The effect of the inhibitors released can be limited, for example, by the incorporation of an inhibitor arresting layer according to DE-A-24 31 223. For reasons of reactivity or stability, it can be of advantage to use a DIR coupler which, in the particular layer into which it is introduced, forms a color differing from the color to be produced in that layer during the coupling reaction.

To increase sensitivity, contrast and maximum density, it is possible above all to use DAR and FAR couplers which release a development accelerator or a fogging agent. Compounds of this type are described, for example, in DE-A-2 534 466, 3 209 110, 3 333 355, 3 410 616, 3 429 545, 3 441 823; in Ep-A-89 834, 110 511, 118 087, 147 765 and in US-A-4,618,572 and 4,656,123.

Examples of the use of DAR couplers can be found in EP-A-193 389.

It can be of advantage to modify the effect of a photographically active group released from a coupler by allowing this group to enter into an intermolecular reaction with another group after its release in accordance with DE-A-3 506 805.

The following are examples of DIR couplers:
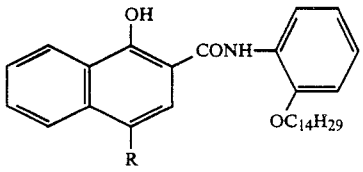
DIR 1
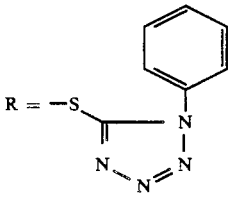
DIR 2
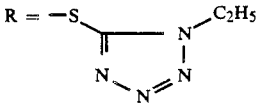
DIR 3
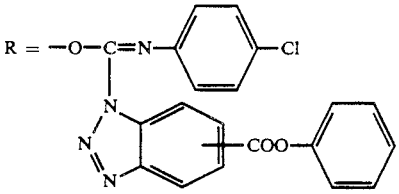
DIR 4
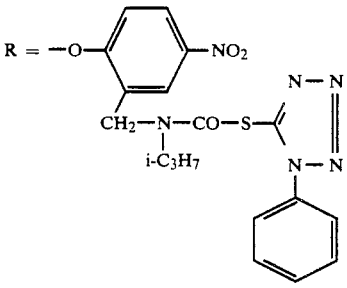
DIR 5
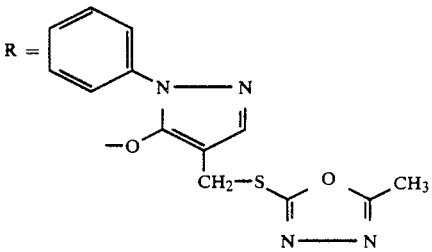
DIR 6
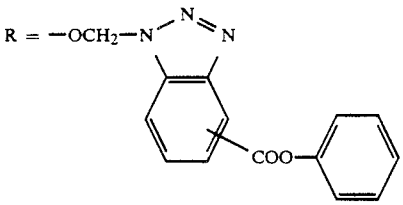

-continued
DIR 7
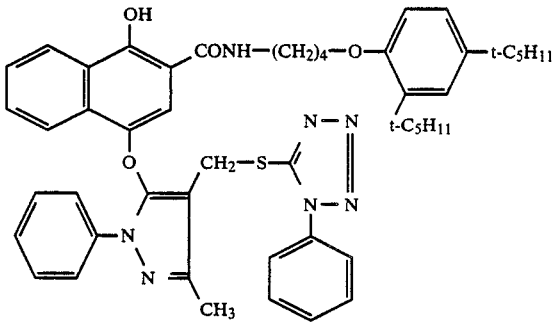
DIR 8
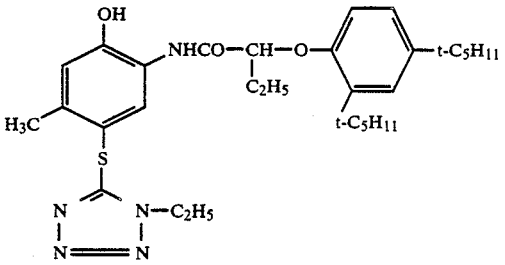
DIR 9
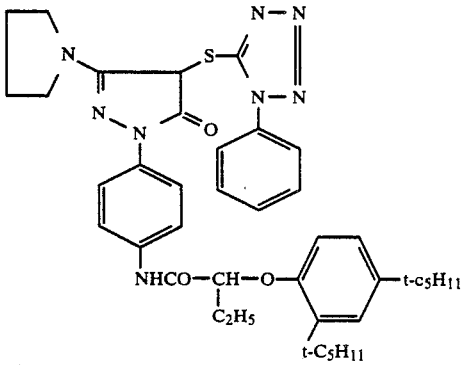
DIR 10
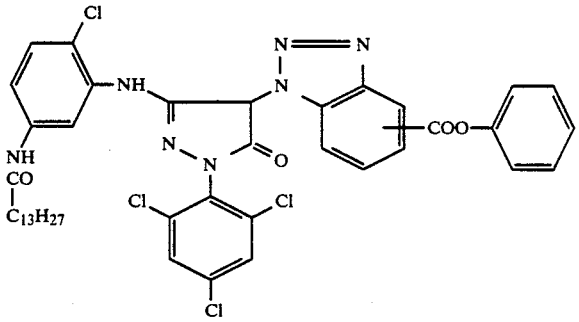

-continued
DIR 11
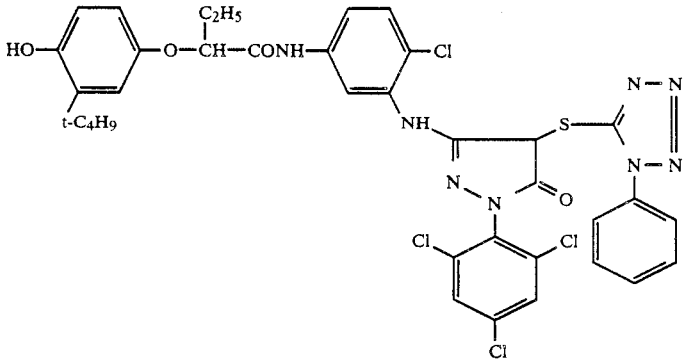
DIR 12
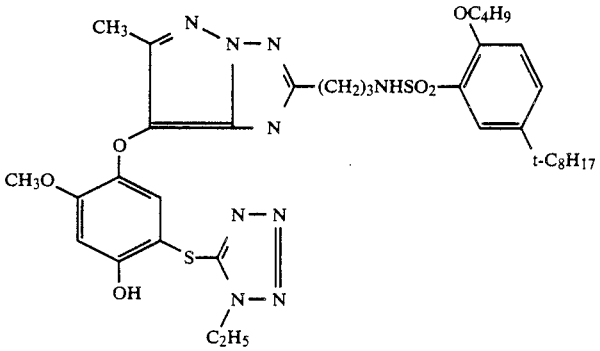
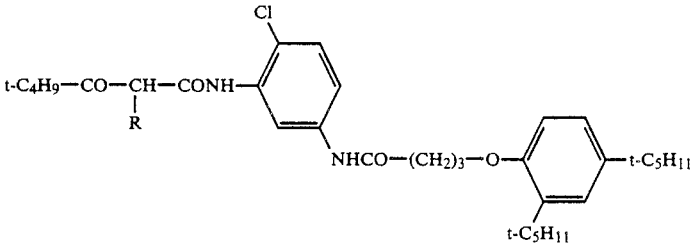
DIR 13
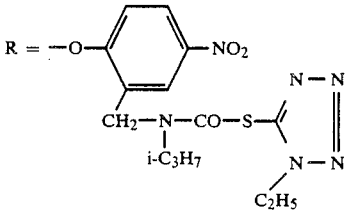
DIR 14
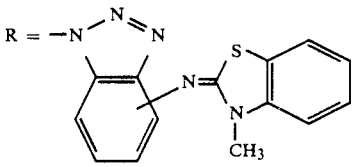
DIR 15
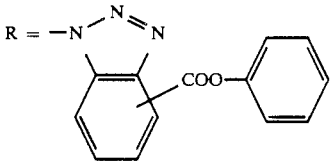

-continued
DIR 16
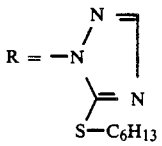
DIR 17
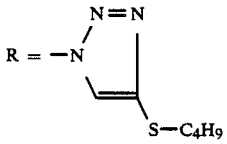
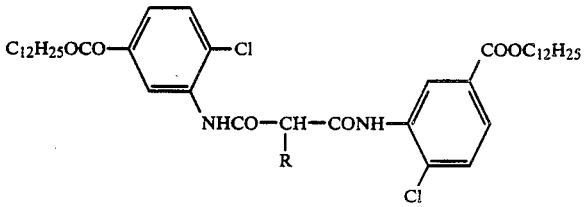
DIR 18
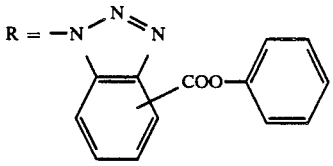
DIR 19
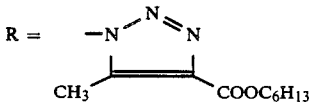
DIR 20
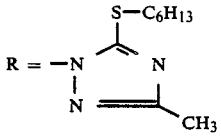
DIR 21
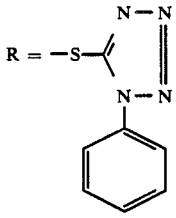
DIR 22
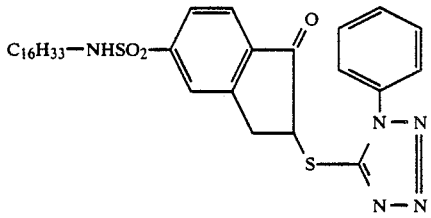

-continued

DIR 23

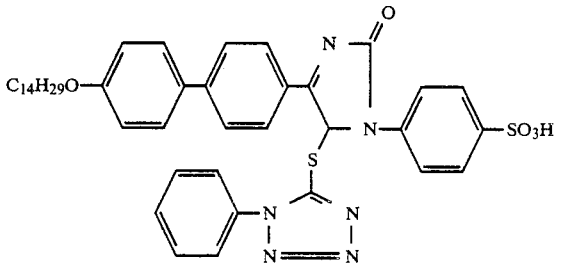

DIR 24

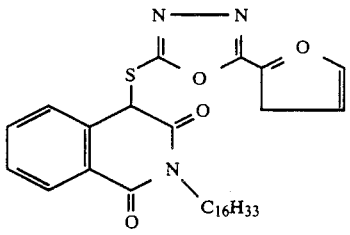

The following are examples of DAR couplers:

DAR 1

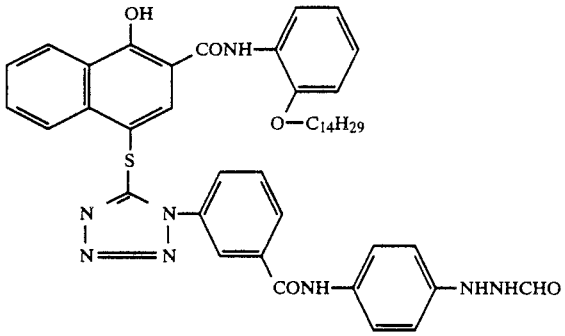

DAR 2

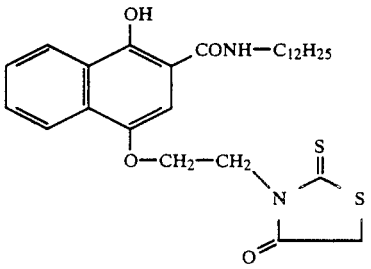

DAR 3

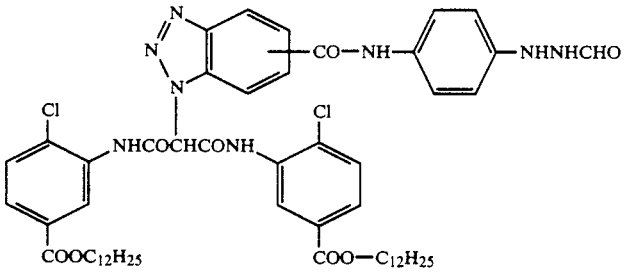

Since, in the case of DIR, DAR and FAR couplers, it is primarily the activity of the group released during the coupling reaction which is desirable, the dye-producing properties of these couplers being less important, it is also possible to use DIR, DAR and FAR couplers which produce substantially colorless products during the coupling reaction (DE-A-1 547 640).

The releasable group may also be a ballast group so that coupling products .which are diffusible or which at least show weak or limited mobility are obtained during the reaction with color developer oxidation products (US-A-4,420,556).

In addition, the material may contain compounds different from couplers which are capable of releasing, for example, a development inhibitor, a development accelerator, a bleaching accelerator, a developer, a silver halide solvent, a fogging agent or an anti-fogging agent, for example so-called DIR hydroquinones, and other compounds of the type described, for example, in US-A-4,636,546, 4,345,024, 4,684,604 and in DE-A-3 145 640, 2 515 213, 2 447 079 and in EP-A-198 438. These compounds perform the same function as the DIR, DAR or FAR couplers except that they do not form any coupling products.

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, US-A-4,080,211. The high molecular weight color couplers are generally produced by polymerization of ethylenically unsaturated monomeric color couplers, although they may also be obtained by polyaddition or polycondensation.

The couplers or other compounds may be incorporated in silver halide emulsion layers by initially preparing a solution, a dispersion or an emulsion of the compound in question and then adding it to the casting solution for the particular layer. The choice of a suitable solvent or dispersant is determined by the particular solubility of the compound.

Methods for introducing substantially water-insoluble compounds by grinding processes are described, for example, in DE-A-2 609 741 and in DE-A-2 609 742.

Hydrophobic compounds may also be introduced into the casting solution using high-boiling solvents, so-called oil formers. Corresponding methods are described, for example, in US-A-2,322,027, US-A-2,801,170, US-A-2,801,171 and in Ep-A-0 043 037.

Instead of the high-boiling solvents, it is also possible to use oligomers or polymers, so-called polymeric oil formers.

The compounds may also be introduced into the casting solution in the form of charged latices, cf. for example DE-A-2 541 230, DE-A-2 541 274, DE-A-2 835 856, EP-A-0 014 921, EP-A-0 069 671, EP-A-0 130 115, US-A-4 291 113.

Anionic, water-soluble compounds (for example dyes) may also be incorporated in non-diffusing form by means of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethylhexyl phthalate, decyl phthalate, triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexyl phenyl phosphate, 2-ethylhexyl benzoate, dodecyl benzoate, 2-ethylhexyl-p-hydroxybenzoate, diethyl dodecaneamide, N-tetradecyl pyrrolidone, isostearyl alcohol, 2,4-di-tert.amylphenyl, dioctyl acelate, glycerol tributyrate, isostearyl lactate, trioctyl citrate, N,N-dibutyl-2-butoxy-5-tert.-octyl aniline, paraffin, dodecylbenzene and diisopropyl naphthalene.

Each of the differently sensitized photosensitive layers may consist of a single layer or may even comprise two or more partial silver halide emulsion layers (DE-C-1 121 470). In this case, red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being arranged between the green-sensitive layers and blue-sensitive layers.

Providing the green-sensitive and red-sensitive layers are of suitably low natural sensitivity, it is possible to select other layer arrangements without the yellow filter layer, in which for example the blue-sensitive, then the red-sensitive and finally the green-sensitive layers follow one another on the support.

The non-photosensitive intermediate layers generally arranged between layers of different spectral sensitivity may contain agents for preventing unwanted diffusion of developer oxidation products from one photosensitive layer into another photosensitive layer with different spectral sensitization.

Suitable agents of this type, which are also known as scavengers or EOP collectors, are described in Research Disclosurel 7643, 1978, Chapter VII, 17842, 1979, pages 94–97 and 18716, 1979, page 650; in EP-A-69 070, 98 072, 124 877 and 125 522 and in US-A-463,226.

The following are examples of particularly suitable compounds:

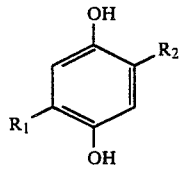

$R_1, R_2$ = -t-$C_8H_{17}$
-sec-$C_{12}H_{25}$
-t-$C_6H_{13}$
$-C(CH_3)_2-(CH_2)_3-COO$-n-$C_6H_{13}$
-sec-$C_8H_{17}$
$-C_{15}H_{31}$

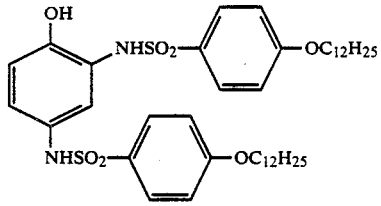

Where several partial layers of the same spectral sensitization are present, they may differ from one another in regard to their composition and particularly in regard to the type and quantity of silver halide crystals. In general, the partial layer of higher sensitivity will be arranged further away from the support than the partial layer of lower sensitivity. Partial layers of the same spectral sensitization may be arranged adjacent one another or may be separated by other layers, for example by layers of different spectral sensitization. For example all layers of high sensitivity and all layers of low sensitivity may be respectively combines to form single layer combinations (DE-A 1 958 709, DE-A 2 530 645, DE-A 2 622 922).

In addition, the photographic material may contain UV absorbers, whiteners, spacers, filter dyes, formalin scavengers, light stabilizers, antioxidants, $D_{min}$ dyes, additiives for improving dye, coupler and white stabilization and for reducing color fogging, etc.

UV absorbers are intended on the one hand to protect the image dyes against fading in UV-rich daylight and, on the other hand, to serve as filter dyes which absorb the UV light in daylight during exposure and thus improve the color reproduction of a film. Compounds of different structure are normally used for these two function. Examples include aryl-substituted benzotriazole compounds (US-A 3,533,794), 4-thiazolidone compounds (US-A-3,314,794 and 3,352,681), benzophenone compounds (JP-A 2784/71), cinnamic acid ester compounds (US-A 3,705,805 and 3,707,375), butadiene compounds (US-A 4,045,229) or benzoxazole compounds (US-A 3,700,455).

The following are examples of particularly suitable compounds:

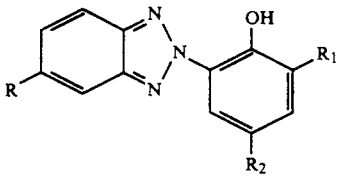

R, $R_1$ = H; $R_2$ = t-$C_4H_9$
R = H; $R_1$, $R_2$ = t-$C_4H_9$
R = H; $R_1$, $R_2$ = t-$C_5H_{11}$-tert,
R = H; $R_1$ = sec-$C_4H_9$; $R_2$ = t-$C_4H_9$
R = Cl; $R_1$ = t-$C_4H_9$; $R_2$ = sec-$C_4H_9$
R = Cl; $R_1$, $R_2$ = t-$C_4H_9$
R = Cl; $R_1$ = t-$C_4H_9$-tert.; $R_2$ = $-CH_2-CH_2-COOC_8H_{17}$
R = H; R = iso-$C_{12}H_{25}$; $R_2$ = $CH_3$
R, $R_1$, $R_2$ = t-$C_4H_9$

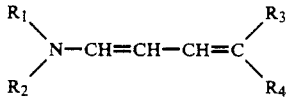

$R_1$, $R_2$ = n-$C_6H_{13}$; $R_3$, $R_4$ = CN $R_1$, $R_2$ = $C_2H_5$; $R_3$ = $-SO_2-$ 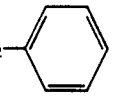 ; $R_4$ = $COOC_8H_{17}$ $R_1$, $R_2$ = $C_2H_5$; $R_3$ = $-SO_2-$ 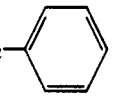 ; $R_4$ = $COOC_{12}H_{25}$ $R_1$, $R_2$ = $CH_2=CH-CH_2$; $R_3$, $R_4$ = CN

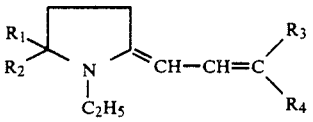

$R_1$, $R_2$ = H; $R_3$ = CN; $R_4$ = $CO-NHC_{12}H_{25}$
$R_1$, $R_2$ = $CH_3$; $R_3$ = CN; $R_4$ = $CO-NHC_{12}H_{25}$

-continued

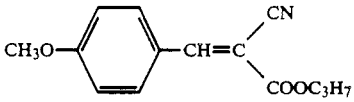

It is also possible to use UV-absorbing couplers (such as cyan couplers of the o-naphthol type) and UV-absorbing polymers. These UV absorbers may be fixed in a special layer by mordanting.

Filter dyes suitable for visible light include oxonol dyes, hemioxonol dyes, styryl dyes, merocyanine dyes, cyanine dyes and azomethine dyes. Of these dyes, oxonol dyes, hemioxonol dyes and merocyanine dyes may be used with particular advantage.

Suitable whiteners are described, for example, in Research Disclosure, December 1978, pages 22 et seq, Report 17643, Chapter V, in US-A-2,632,701 and 3,269,840 and in GB-A-852,075 and 1,319,763.

Certain binder layers, particularly the layer furthest from the support and, occasionally, intermediate layers, particularly where they represent the layer furthest away from the support during production, may contain photographically inert, inorganic or organic particles, for example for matt finishes or as spacers (DE-A 3 331 542, DE-A 3 424 893, Research Disclosure, December 1978, pages 22 et seq, Report 17643, Chapter XVI).

The average particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

The following are examples of suitable formalin scavengers:

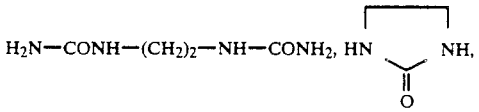

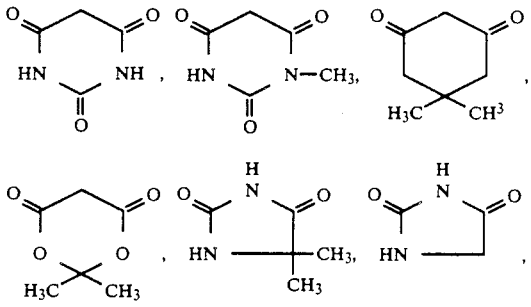

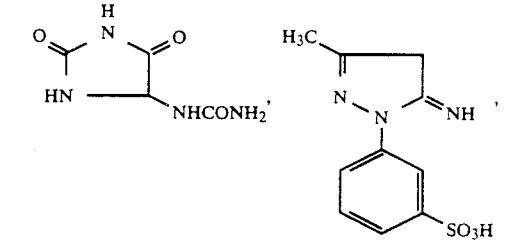

-continued

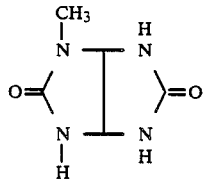

Additives for improving dye, coupler and white stability and for reducing color fogging (Research Disclosure 17643, 1978, Chapter VII) may belong to the following classes of chemical compounds: hydroquinones, 6-hydroxy chromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds which contain both a sterically hindered amine partial structure and also a sterically hindered phenol partial structure in one and the same molecule (US-A-4,268,593) are particularly effective in preventing damage (deterioration or degradation) to yellow dye images as a result of the effect of heat, moisture and light. Spiroindanes (JP-A-159 644/81) and chromanes substituted by hydroquinone diethers or monoethers (JP-A-89 835/80) are particularly effective in preventing damage (deterioration or degradation) to magenta-red dye images, particularly as a result of the effect of light.

The following are examples of particularly suitable compounds:

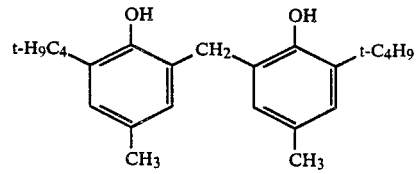

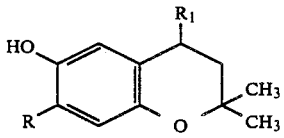

R = t-$C_8H_{17}$; $R_1$ = $CH_3$
R = n-$C_8H_{17}$; $R_1$ = i-$C_3H_7$

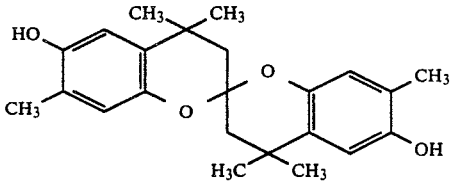

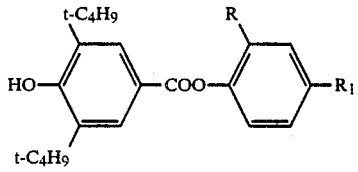

R, $R_1$ = t-$C_4H_9$
R, $R_1$ = t-$C_5H_{11}$

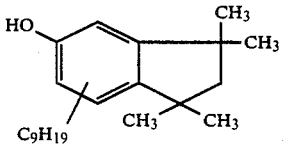

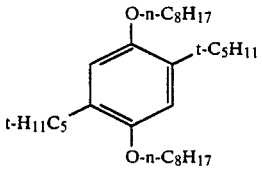

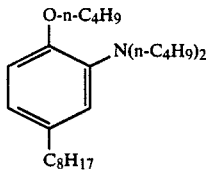

-continued

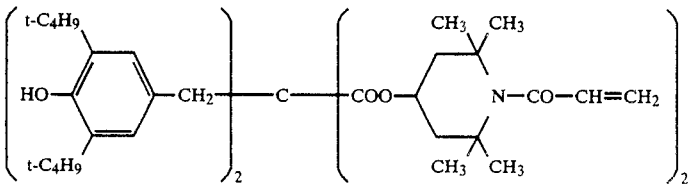

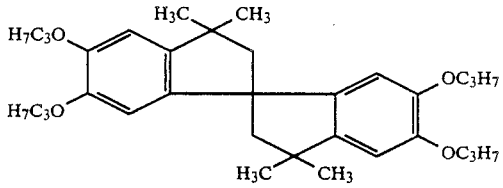

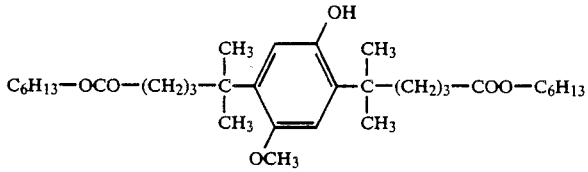

and also the compounds mentioned as EOP collectors.

The layers of the photographic material may be hardened with the usual hardening agents. Suitable hardening agents are, for example, formaldehyde, glutaraldehyde and similar aldehyde compounds, diacetal, cyclopentadiene and similar ketone compounds, bis-(2-chloroethylurea), 2-hydroxy-4,6-dichloro-1,3,5-triazine and other compounds containing reactive halogen (US-A 3,288,775, US-A-2,732,303, GB-A-974,723 and GB-A-I,167,207), divinyl sulfone compounds, 5-acetyl-1,3-diacryloylhexahydro-1,3,5-triazine and other compounds containing a reactive olefinic bond (US-A 3,635,718, US-A-3,232,763 and GB-A 994,869); N-hydroxymethyl phthalimide and other N-methylol compounds (US-A 2,732,316 and US-A 2,586,168): isocyanates (US-A 3,103,437); aziridine compounds (US-A 3,017,280 and US-A 2,983,611); acid derivatives (US-A 2,725,294 and US-A 2,725,295); compounds of the carbodiimide type (US-A 3,100,704); carbamoyl pyridinium salts (DE-A 2 225 230 and DE-A 2 439 551); carbamoyloxy pyridinium compounds (DE-A 2 408 814); compounds containing a phosphorus-halogen bond (JP-A-113 929/83); N-carbonyloximide compounds (JP-A-43 353/81); N-sulfonyloximido compounds (US-A-4,111,926), dihydroquinoline compounds (US-A-4,013,468), 2-sulfonyloxy pyridinium salts (JP-A-110 762/81), formamidinium salts (EP-A 0 162 308), compounds containing two or more N-acyloximino groups (US-A 4,052,373), epoxy compounds (US-A 3,091,537), compounds of the isoxazole type (US-A 3,321,313 and US-A-3,543,292); halocarboxaldehydes, such as mucochloric acid; dioxane derivatives, such as dihydroxydioxane and dichlorodioxane; and inorganic hardening agents, such as chrome alum and zirconium sulfate.

Hardening may be carried out in known manner by adding the hardening agent to the casting solution for the layer to be hardened or by coating the layer to be hardened with a layer containing a diffusible hardening agent.

Within the classes mentioned, there are slow-acting hardeners and fast-acting hardeners and also so-called. instant hardeners which are particularly advantaeous. Instant hardeners are compounds which crosslink suitable binders in such a way that, immediately after casting and, at the latest, 24 hours and preferably 8 hours after casting, hardening has advanced to such an extent that the crosslinking reaction produces no further change in the sensitometry and swelling of the layer combination. By swelling is meant the difference between wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that the latter react with free amino groups of the gelatine to form peptide bonds and crosslink the gelatine.

Suitable examples of instant hardeners are compounds corresponding to the following general formulae:

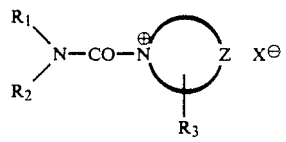

(a)

in which $R_1$ is alkyl, aryl or aralkyl, $R_2$ has the same meaning as $R_1$ or represents alkylene, arylene, aralkylene or alkaralkylene, the second bond being attached to a group corresponding to formula

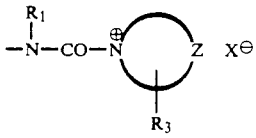

or $R_1$ and $R_2$ together represent the atoms required to complete an optionally substituted heterocyclic ring, for example a piperidine, piperazine or morpholine ring, the ring optionally being substituted, for example, by $C_{1-3}$ alkyl or halogen, $R_3$ is hydrogen, alkyl, aryl, alkoxy, $-NR_4-COR_5$, $-(CH_2)_M-NR_8R_9$, $-(CH_2)_n-CONR_{13}R_{14}$ or $$-(CH_2)_p-\underset{\underset{R_{15}}{|}}{CH}-Y-R_{16}$$

or is a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$-$C_4$ alkyl, $R_5$ being hydrogen, $C_{1-4}$ alkyl or $NR_6R_7$, $R_8$ being $-COR_{10}$, $R_{10}$ being $NR_{11}R_{12}$, $R_{11}$ being $C_{1-4}$ alkyl or aryl, particularly phenyl, $R_{12}$ being hydrogen, $C_{1-4}$ alkyl or aryl, particularly phenyl, $R_{13}$ being hydrogen, $C_{1-4}$ alkyl or aryl, particularly phenyl, $R_{16}$ being hydrogen, $C_{1-4}$ alkyl, $COR_{18}$ or $CONHR_{19}$, m being a number of 1 to 3, n being a number of 0 to 3, p being a number of 2 to 3 and Y being 0 or $NR_{17}$ or $R_{13}$ and $R_{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6-membered aromatic heterocyclic ring, optionally with a fused benzene ring, and $X^{\ominus}$ is an anion which is unnecessary where an anionic group is already attached to the rest of the molecule;

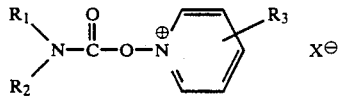

(b)

in which $R_1$, $R_2$, $R_3$ and $X^{\ominus}$ are as defined for formula (a).

There are diffusible hardeners which have the same hardening effect on all the layers of a layer combination. However, there are also non-diffusing, low molecular weight and high molecular weight hardeners which act only on certain layers. With hardeners of this type, it is possible to crosslink individual layers, for example the protective layer, to a particularly high degree. This is important where the silver halide layer is minimally hardened on account of the increase in the silver hiding power and the mechanical properties have to be improved through the protective layer (EP-A 0 114 699).

Color photographic negative materials are normally processed by development, bleaching, fixing and rinsing or by development, bleaching, fixing and stabilization with no subsequent rinsing; bleaching and fixing may also be combined into a single step. Suitable color developer compounds are any developer compounds which are capable of reacting with color couplers in the form of their oxidation product to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methanesulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other suitable color developers are described, for example, in J. Amer. Chem. Soc. 73, 3106 (1951) and G. Haist, Modern Photographic Processing, 1979, John Wiley and Sons, New York, pages 545 et seq.

Color development may be followed by an acid stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraacetic acid, diethylenetriamine pentaacetic acid, nitrilotriacetic acid, iminodiacetic acid, N-hydroxyethyl ethylenediamine triacetic acid, alkyliminodicarboxylic acids, and corresponding phosphonic acids. Other suitable bleaches are persulfates.

Bleaching/fixing or fixing is generally followed by washing which is carried out as countercurrent washing or in several tanks with their own water supply.

Suitable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

Since the compounds according to the invention increase graininess in the region of low color densities, it is advisable, in the case of materials containing more than one layer for one spectral region, to add these compounds to the partial layers of highest sensitivity.

In general, the compounds according to the invention increase not only the developable density in the exposure range, but also that of any fog present. Accordingly, it is best to combine the addition of the compounds according to the invention with an addition of suitable photographic stabilizers. Compounds which have been successfully used as stabilizers are, for example, compounds corresponding to the following general formula

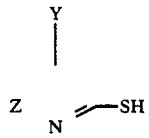

in which

Z represents the atoms required to complete an oxazole or oxazine ring and

Y represents a fused aromatic ring system comprising at least one aromatic ring, which may be substituted by an acidic group, or a substituent containing an acidic group.

EXAMPLE 1

Individual layers

The following layers were applied to a transparent layer support of cellulose triacetate.

The quantities applied are all based on square meter. For the silver halide applied, the corresponding quantities of $AgNO_3$ are shown.

0.03 mmol of the grain-active latent fogging agent according of the invention or of the comparison compound shown in Table 1 was added to 4.0 g $AgNO_3$ of a spectrally green-sensitized Ag(Cl, Br, I) emulsion containing 4.5 mol-% $I^{\ominus}$, 2.0 mol-% $Cl^{\ominus}$, *mean grain size* 0.65 μm, crystallographically limited by 100-surfaces, stabilized with 30 mg 4-hydroxy-6-methyl-1,3,3a,7-tetraazaindene and 80 mg of the stabilizer.

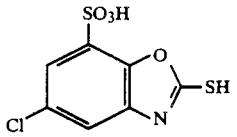

which contained 2.8 g gelatine.

0.8 g of the color coupler

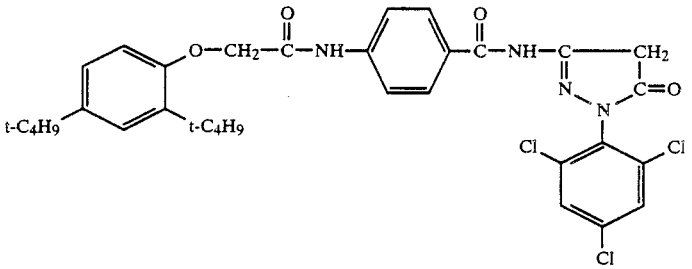

in 0.8 g tricresyl phosphate were added.

The layers were coated with a protective gelatine layer (0.5 μm dry layer thickness) and hardened with 0.3 g/m² of the hardener

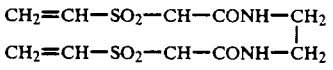

After imagewise exposure with white light, exposure time 1/100 sec., behind a grey sensitometer wedge, the samples were processed by the color negative process described in The British Journal of Photography, 1974, pages 597 to 598.

The photographic sensitivities are shown in the following Table. Comparison compound:

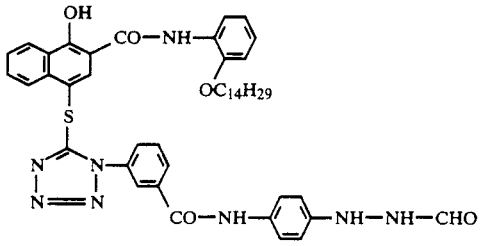

TABLE 1

| | Addition | | | |
|---|---|---|---|---|
| | Compound | Molecular weight | mmol per mol $AgNO_3$ | Photogr. sensitivity |
| Comparison | none | — | — | 23.2 DIN |

TABLE 1-continued

| | Addition | | | |
|---|---|---|---|---|
| | Compound | Molecular weight | mmol per mol $AgNO_3$ | Photogr. sensitivity |
| " | Comparison compound | 829.1 | 0.03 | 23.6 DIN |
| Invention | 15 | 355.5 | 0.03 | 26.8 DIN |
| " | 22 | 288.3 | 0.03 | 26.7 DIN |
| " | 23 | 376.4 | 0.03 | 26.5 DIN |
| " | 24 | 347.4 | 0.03 | 26.8 DIN |
| " | 25 | 346.8 | 0.03 | 26.4 DIN |
| " | 26 | 316 | 0.03 | 25.2 DIN |

EXAMPLE 2

The layer combinations A to G and also the comparison combination H without the corresponding additives were prepared as described in the following by addition of the comparison compound and the compounds according to the invention to the high-sensitivity partial layers 9, 11 and 13 and successively casting layers 1 to 14 onto a transparent layer support.

The layer supports, quantities and stabilization of the emulsions were as in Example 1.

1st Layer (Antihalo layer)
- 0.2 g black colloidal silver
- 1.2 g gelatine
- 0.1 g UV absorber UV 1
- 0.2 g UV absorber UV 2
- 0.02 g tricresyl phosphate
- 0.03 g dibutyl phthalate 2nd Layer (Micrate intermediate layer)
- 0.4 g $AgNO_3$ of a micrate Ag(Br,I) emulsion, mean grain diameter 0.05 μm, 2 mol-% iodide
- 1.2 g gelatine
- 0.08 g colored coupler RM 1
- 0.15 g dibutyl phthalate 3rd Layer (Low red-sensitivity layer)
- 2.0 g $AgNO_3$ of a spectrally red-sensitized Ag(Br,I) emulsion containing 3.5 mol-% iodide, mean grain diameter 0.42 μm
- 2.0 g gelatine
- 0.58 g colorless coupler C1
- 0.02 g DIR coupler DIR 1
- 0.02 g DIR coupler DIR 2
- 0.05 g colored coupler RM 1
- 0.40 g tricresyl phosphate
- 0.15 g dibutyl phthalate 4th Layer (Separation layer)
- 0.8 g gelatine
- 0.05 g 2,5-di-t-pentadecyl hydroquinone
- 0.05 g tricresyl phosphate
- 0.05 g dibutyl phthalate 5th Layer (Low green-sensitivity layer)

1.8 g $AgNO_3$ of a spectrally green-sensitized Ag(Br,I) emulsion, 4.35 mol-% iodide, mean grain diameter 0.36 μm
1.6 g gelatine
0.45 g colorless coupler M 2
0.05 g DIR coupler DIR 2
0.12 g colored coupler YM 1
0.52 g tricresyl phosphate 6th Layer (Yellow filter layer)
0.02 g yellow colloidal silver passivated by 6 mg 1-phenyl-5-mercaptotetrazole/g $AgNO_3$
0.8 g gelatine
0.15 g 2,5-di-t-pentadecyl hydroquinone 7th Layer (Low blue-sensitivity layer)
0.65 g of a spectrally blue-sensitized Ag(Br,I) emulsion, 4.5 mol-% iodide, mean grain diameter 0.43 μm
1.95 g gelatine
0.85 g colorless coupler Y 1
0.15 g DIR coupler DIR 3
0.90 g tricresyl phosphate 8th Layer (Separation layer)
As 4th layer 9th Layer (High red-sensitivity layer)
2.2 g $AgNO_3$ of the spectrally red-sensitized Ag(Br,I) emulsion, 6.3 mol-% iodide, mean grain diameter 0.82 μm, provided with the additives or the comparison additives shown in Table 2,
1.2 g gelatine
0.20 g colorless coupler C 2
0.01 g DIR coupler DIR 2
0.02 g colored coupler RM 1
0.15 g tricresyl phosphate
0.10 g dibutyl phthalate 10th Layer (Separation layer)
As 4th layer 11th Layer (High green-sensitivity layer)
2.0 g $AgNO_3$ of a spectrally green-sensitized Ag(Br,I) emulsion, 7.5 mol-% iodide, mean grain diameter 0.82 μm, provided with the additives according to the invention or with the comparison additives shown in Table 2,
1.2 g gelatine
0.16 g colorless coupler M 1
0.01 g DIR coupler DIR 2
0.03 g colored coupler YM 1
0.15 g tricresyl phosphate 12th Layer (Yellow filter layer)
As 6th layer 13th Layer (High blue-sensitivity layer)
0.85 g $AgNO_3$ of a spectrally blue-sensitized Ag(Br,I) emulsion, 10.2 mol-% iodide, mean grain diameter 1.25 μm, provided with the additives according the invention or with the comparison additives shown in Table 2,
1.2 g gelatine
0.15 g colorless coupler Y 2
0.01 g DIR coupler DIR 2
0.25 g tricresyl phosphate 14th Layer (Protective and hardening layer)
0.5 g $AgNO_3$ of a micrate Ag(Br,I) emulsion, mean grain diameter 0.07 μm, 0.5 mol-% iodide,
1.2 g gelatine
0.4 g of the following hardener

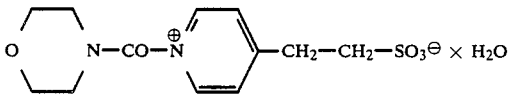

1.0 g of the following formaldehyde scavenger

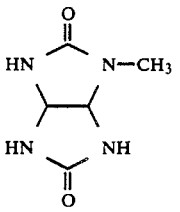

0.08 g dibutyl phthalate
0.24 g of the UV absorber mixture used in the first layer
0.25 g polymethacrylate particles, mean particle diameter 1.45 μm Compounds used in Example 2:

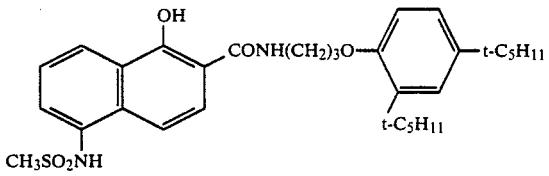

C 1

-continued
C 2
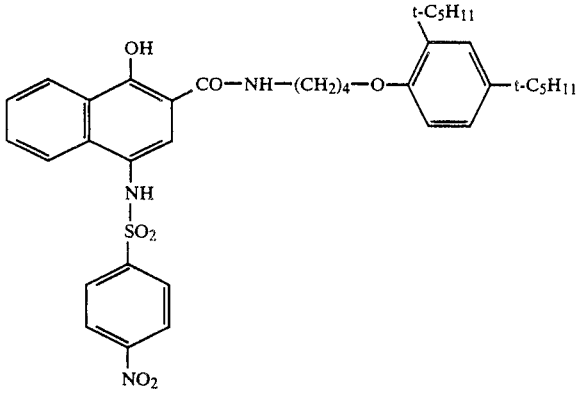
RM 1
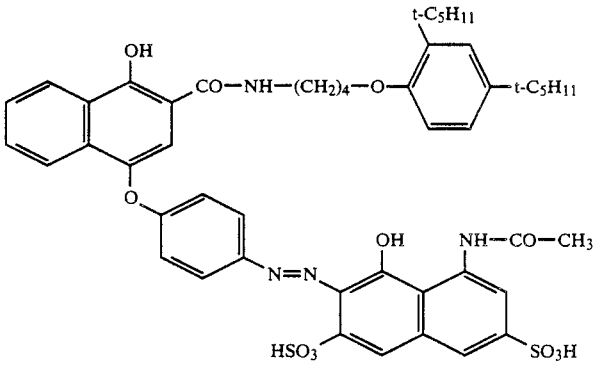
M 1
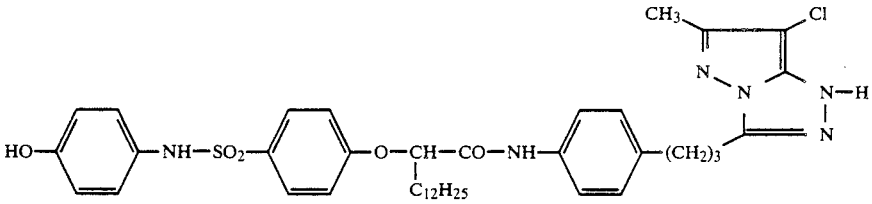
M 2
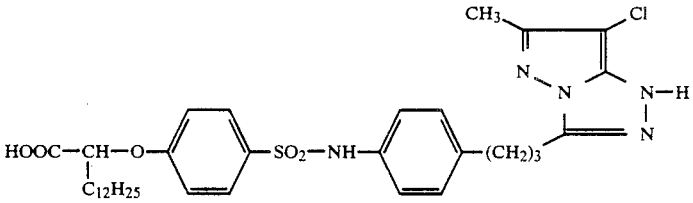
YM 1
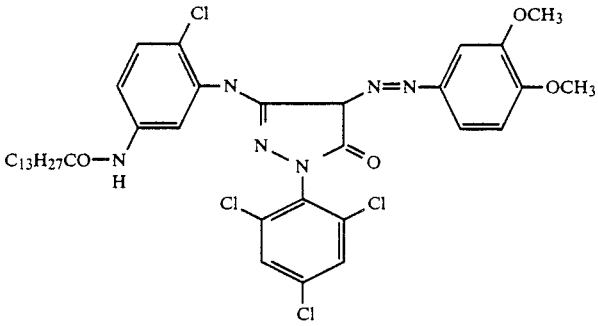

-continued
Y 1
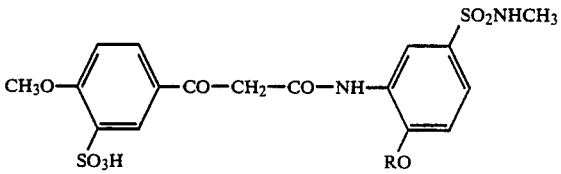
R = $C_{16}H_{33}$ / $C_{18}H_{37}$ ] 7:3
Y 2
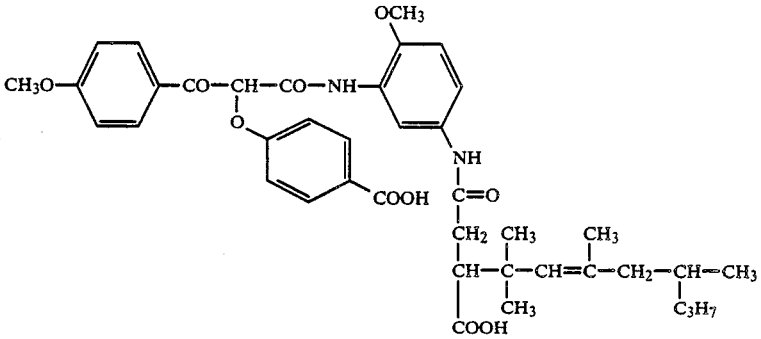
DIR 1
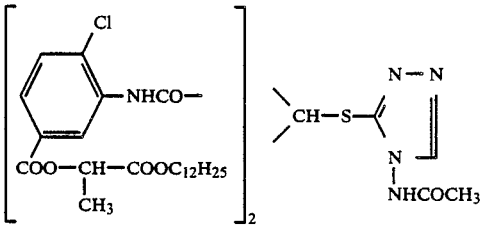
DIR 2
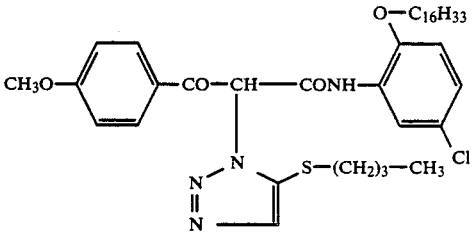
DIR 3
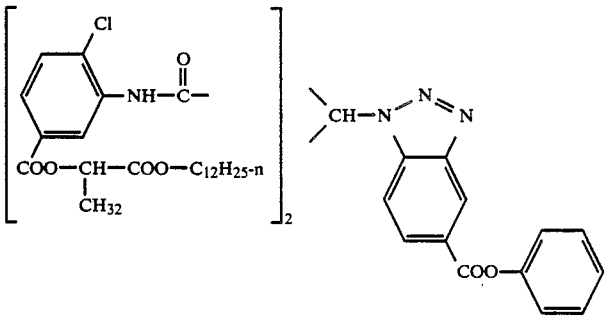
UV 1
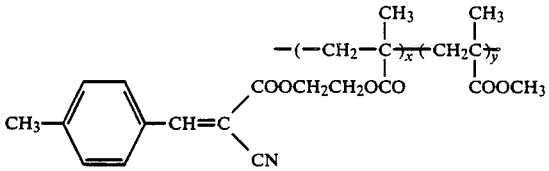
ratio by weight
x:y = 7:3

-continued

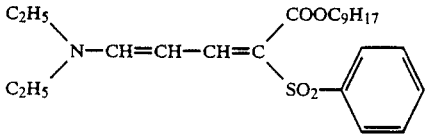

UV 2

TABLE 2

| | Layer Combination | Addition Type | mmol per mol $AgNO_3$ to: 9th layer | 11th layer | 13th layer | Sensitivity cy | mg | y |
|---|---|---|---|---|---|---|---|---|
| Comparison | H | none | — | — | — | 26.2 | 26.4 | 27.0 |
| " | A | Comparison compound | 0.03 | 0.04 | 0.05 | 26.4 | 26.7 | 27.2 |
| Invention | B | 15 | 0.03 | 0.04 | 0.05 | 27.8 | 28.0 | 29.2 |
| " | C | 22 | 0.02 | 0.02 | 0.03 | 28.0 | 28.5 | 29.1 |
| " | D | 23 | 0.03 | 0.04 | 0.04 | 28.2 | 28.5 | 29.0 |
| " | E | 24 | 0.02 | 0.02 | 0.03 | 28.3 | 28.7 | 29.2 |
| " | F | 25 | 0.03 | 0.03 | 0.03 | 28.1 | 28.6 | 29.4 |
| " | G | 26 | 0.02 | 0.03 | 0.05 | 27.8 | 28.9 | 28.8 |

We claim:

1. A color photographic silver halide material of the negative type, which contains at least one red-sensitive layer containing at least one cyan coupler, at least one green-sensitive layer containing at least one magenta coupler and at least one blue-sensitive layer containing a yellow coupler, in which at least one silver halide emulsion layer contains a compound corresponding to the following formula $$A-(Z)_n-F^* \quad (I)$$

adsorbed on the silver halide grain,

A being a grain-active attachment group corresponding to formulae IIa to IId:

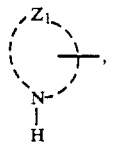

IIa

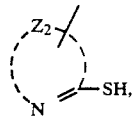

IIb

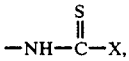

IIc

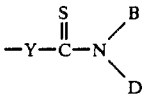

IId $Z_1$ representing the remaining members for completing a preferably 5- or 6-membered ring which contains at least one other heteroatom, such as a nitrogen or sulfur atom, $Z_2$ representing the remaining members for completing a preferably 5- or 6-membered ring, X representing $—NH_2$, NHR,

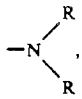

$—NH—NH_2$, —NH—NHR, —SR,

Y representing —S—, —NH—, —NR—,

B and D representing hydrogen, R or, together, the remaining members of a 5- or 6-membered ring, R representing an aliphatic, aromatic or heterocyclic radical, Z representing a difunctional intermediate member, n=0 or 1, F* is a latent fogging agent group which becomes the active fogging agent (F) during color development corresponding the following formula IIIc

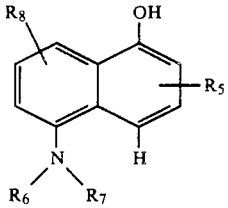

in which (one of the substituents $R_5$, $R_6$, $R_7$ and $R_8$ in formula IIIc being the point of attachment for the residue $A-(Z)_n-$,)

$R_5$ is hydrogen, $—CONHR_9$, $—NHCOR_9$, $—SO_2NHR_9$, $—NHCOOR_9$, $—NHSO_2R_9$, $—NHCONHR_9$, $R_6$ is hydrogen or alkyl, $R_7$ is hydrogen or acyl, such as $—COR_9$, $—COOR_9$, $—CONHR_9$, $SO_2NHR_3$ or $R_6$ and $R_7$ together represent the remaining members of a heterocyclic ring or, together with the nitrogen atom, represent an azomethine group

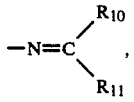

$R_8$ is hydrogen, alkoxy or acylamino, $R_8$ and $R_6$ together represent the remaining members of a heterocyclic ring, which is condensed with the naphthol ring, $R_9$ is an optionally substituted, aliphatic or olefinic, cycloaliphatic or cycloolefinic, aromatic or heterocyclic group, $R_{10}$ is hydrogen, alkyl, aryl, and $R_{11}$ is alkyl, aryl or hetaryl.

2. A color photographic silver halide material as claimed in claim 1, characterized in that Z represents alkylene, arylene, $—COCH_2$, $—COCH_2—S—$, $—COCH_2—O—$,

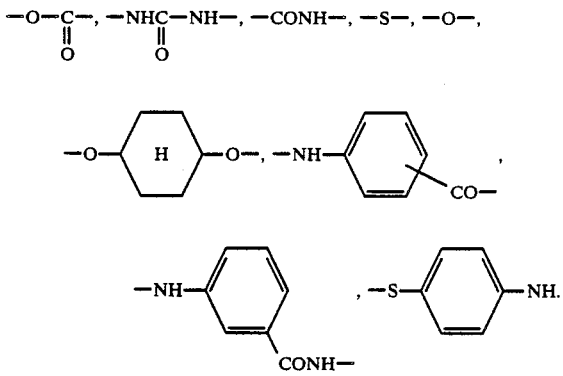

3. A color photographic silver halide material as claimed in claim 2 wherein $Z_1$ represents the remaining members for completing a benzo-condensed ring.

4. A color photographic silver halide material as claimed in claim 1 wherein $Z_2$ represents the remaining members for completing a benzo-condensed ring.

5. A color photographic silver halide material as claimed in claim 1 wherein $Z_1$ represents the remaining members for completing a naphtho-condensed ring.

6. A color photographic silver halide material as claimed in claim 1 wherein $Z_2$ represents the remaining members for completing a naphtho-condensed ring.

7. A color photographic silver halide material as claimed in claim 1, characterized in that the compound I corresponds to formula (IV)

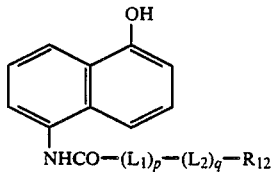

(IV)

in which $L_1$ is a $C_{1-6}$ alkylene radical, $L_2$ is a sulfur atom, $R_{12}$ is a heterocyclic radical, p=0 or 1 and q=0 or 1.

8. A color photographic silver halide material as claimed in claim 1, characterized in that compound I is added to the silver halide emulsion after spectral sensitization in a quantity of from 0.005 to 1 mmol/mol $AgNO_3$.

9. A color photographic silver halide material as claimed in claim 1, characterized in that it contains layers of the same spectral sensitization, but different sensitivity, the compound corresponding to formula (I) being in the layer of highest sensitivity.

10. A color photographic material as claimed in claim 1 which contains at least two red-sensitive, at least two green-sensitive and at least two blue-sensitive layers, all the layers of highest sensitivity containing a compound corresponding to formula (I).

* * * * *